US009335702B2

(12) United States Patent
Sugaya

(10) Patent No.: US 9,335,702 B2
(45) Date of Patent: May 10, 2016

(54) IMAGE FORMING APPARATUS AND SHEET STORAGE DEVICE

(71) Applicant: CANON KABUSHIKI KAISHA, Tokyo (JP)

(72) Inventor: Hajime Sugaya, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/493,516

(22) Filed: Sep. 23, 2014

(65) Prior Publication Data

US 2015/0086225 A1 Mar. 26, 2015

(30) Foreign Application Priority Data

Sep. 24, 2013 (JP) ..... 2013-197216

(51) Int. Cl.
*G03G 15/00* (2006.01)

(52) U.S. Cl.
CPC ..... *G03G 15/6552* (2013.01); *G03G 15/50* (2013.01)

(58) Field of Classification Search
CPC ..... G03G 15/6552; G03G 15/6547; G03G 15/6538; G03G 2215/00911; B65H 39/11; B65H 31/24; B65H 31/26; B65H 31/3081; B65H 83/00; B65H 2405/332; B65H 2407/133; B65H 2511/412; B65H 2402/443; B41J 13/106
See application file for complete search history.

(56) References Cited

U.S. PATENT DOCUMENTS

| | | | | |
|---|---|---|---|---|
| 6,428,226 | B1 * | 8/2002 | Suzuki et al. | 400/642 |
| 2006/0269339 | A1 * | 11/2006 | Okamoto et al. | 399/401 |
| 2011/0293347 | A1 * | 12/2011 | Sekino et al. | 400/582 |
| 2012/0217693 | A1 * | 8/2012 | Fukami | 270/58.08 |

FOREIGN PATENT DOCUMENTS

| | | | |
|---|---|---|---|
| JP | 072422 | A | 1/1995 |
| JP | 07125909 | A | 5/1995 |
| JP | 08113420 | A | 5/1996 |

* cited by examiner

*Primary Examiner* — Blake A Tankersley
(74) *Attorney, Agent, or Firm* — Canon U.S.A., Inc. IP Division

(57) ABSTRACT

An image forming apparatus includes a storage portion, an opening, a moving unit, and a pressing unit that can be moved between a pressing position where the pressing unit presses a surface of a sheet in a exposure state and a retreat position where the pressing unit retracts from the pressing position.

21 Claims, 16 Drawing Sheets

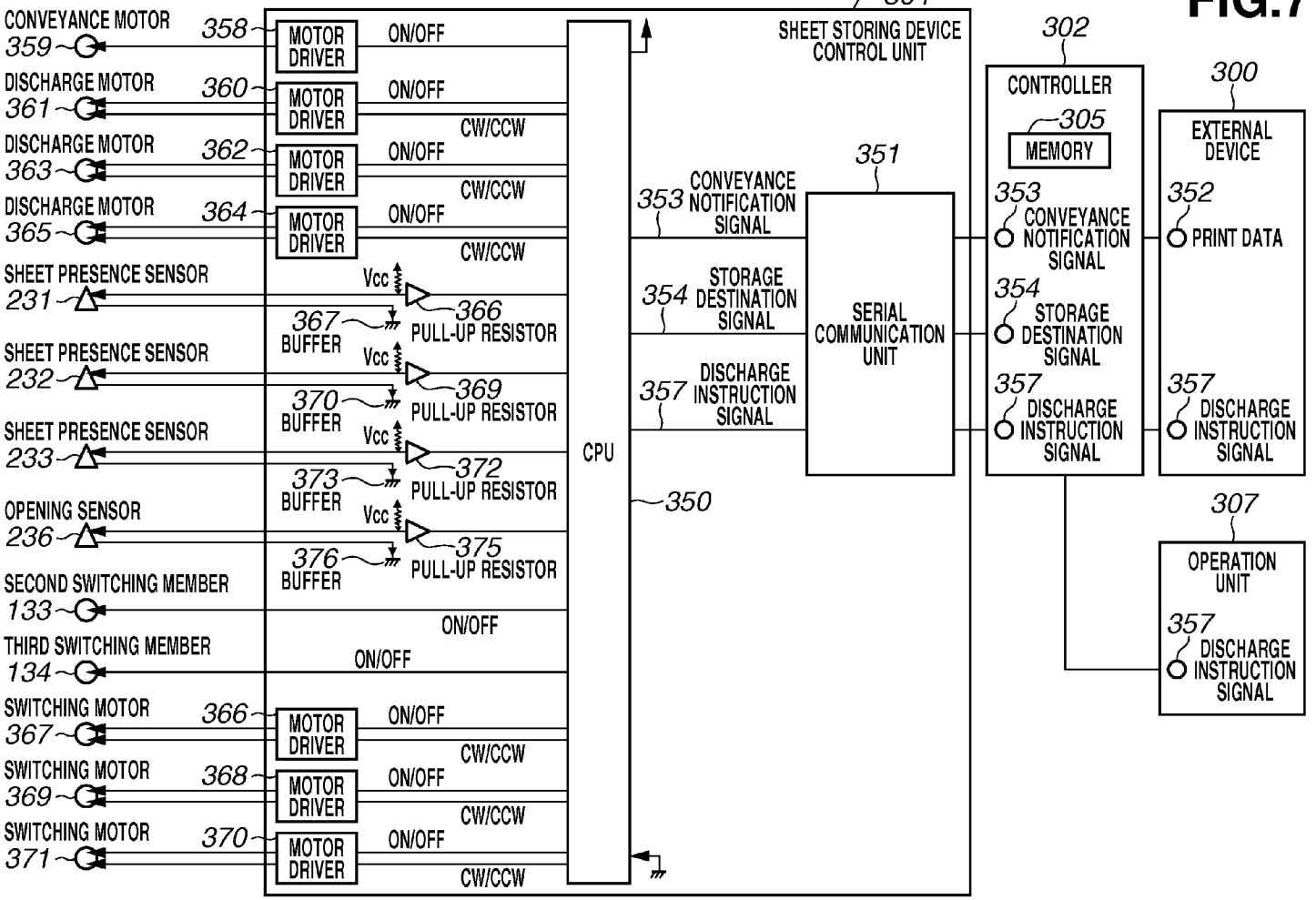
FIG.7
300
EXTERNAL DEVICE
352
PRINT DATA
357
DISCHARGE INSTRUCTION SIGNAL
307
OPERATION UNIT
357
DISCHARGE INSTRUCTION SIGNAL
302
CONTROLLER
305
MEMORY
353
CONVEYANCE NOTIFICATION SIGNAL
354
STORAGE DESTINATION SIGNAL
357
DISCHARGE INSTRUCTION SIGNAL
304
SHEET STORING DEVICE CONTROL UNIT
351
SERIAL COMMUNICATION UNIT
CONVEYANCE NOTIFICATION SIGNAL
353
STORAGE DESTINATION SIGNAL
354
DISCHARGE INSTRUCTION SIGNAL
357
350
CPU
ON/OFF
CW/CCW
MOTOR DRIVER
Vcc
366
369
372
375
PULL-UP RESISTOR
367
370
373
376
BUFFER
CONVEYANCE MOTOR
358
359
DISCHARGE MOTOR
360
361
DISCHARGE MOTOR
362
363
DISCHARGE MOTOR
364
365
SHEET PRESENCE SENSOR
231
SHEET PRESENCE SENSOR
232
SHEET PRESENCE SENSOR
233
OPENING SENSOR
236
SECOND SWITCHING MEMBER
133
THIRD SWITCHING MEMBER
134
SWITCHING MOTOR
366
367
SWITCHING MOTOR
368
369
SWITCHING MOTOR
370
371

DISCHARGE INSTRUCTION BY USER A

RETRACTION OF SHEET

MOVEMENT OF MOVING UNIT 241

MOVEMENT OF MOVING UNIT 241

IMAGE FORMING APPARATUS AND SHEET STORAGE DEVICE

BACKGROUND

1. Field

Aspects of the present invention generally relate to an image forming apparatus that includes a sheet storage portion configured to temporarily store a sheet on which an image is formed in an apparatus body.

2. Description of the Related Art

There is a conventional image forming apparatus (e.g., a copy machine or a printer) that includes a sheet storage portion capable of temporarily storing sheets in the apparatus body in such a way as to prevent each printed image-formed sheet from being seen by other users so that respective users can securely receive their own sheets.

As discussed in Japanese Patent Application Laid-Open No. 7-125909, there is a conventional image forming apparatus including a plurality of sheet storage portions that can temporarily store printed image-formed sheets in an apparatus body, in addition to an ordinary discharge tray that is provided on an upper surface of the apparatus body and can be commonly used by a plurality of users. The sheets stored in these sheet storage portions cannot be seen by other users from the outside of the apparatus body. According to the above-mentioned conventional image forming apparatus, the plurality of sheet storage portions can be allocated to a plurality of users and each sheet can be distributed to a sheet storage portion allocated to a corresponding user. When an individual user receives sheets from the image forming apparatus, the user instructs the image forming apparatus to perform a discharge operation. The image forming apparatus discharges the sheets stored in a sheet storage portion allocated to the discharge operation instructing user to the outside of the apparatus body. Thus, respective users can receive their own sheets (printed image-formed sheets) securely without being seen by other users.

However, the image forming apparatus discussed in Japanese Patent Application Laid-Open No. 7-125909 has an opening through which the sheets stored in respective sheet storage portions can be discharged to the outside of the apparatus body. Further, a discharge tray is provided to stack the sheets discharged through the opening. However, according to the above-mentioned image forming apparatus including the dedicated discharge tray, the apparatus size and costs will increase significantly. On the other hand, it may be feasible to cause each sheet to partly expose to the outside beyond the opening instead of providing the above-mentioned discharge tray. Employing the latter configuration is advantageous in that the apparatus size and costs do not increase because the dedicated discharge tray is not required.

However, a user may fail to pick up a sheet partly exposed from the image forming apparatus through the opening. In this case, the sheet will be left for a long time in a partly exposed state. Other user may erroneously pick up the sheet if the sheet is continuously left in a partly exposed state.

SUMMARY

Aspects of the present invention are generally directed to an image forming apparatus that can prevent a sheet from being erroneously picked up by other user when the sheet is left in a state where the sheet is partly exposed through an opening.

According to an aspect of the present invention, an image forming apparatus includes a storage portion configured to store a sheet, on which an image is formed, inside the image forming apparatus, an opening configured to expose the sheet stored in the storage portion to the outside from the image forming apparatus, a moving unit configured to move the sheet stored in the storage portion and stop the sheet in a exposure state that a part of the sheet is exposed from the opening, and a pressing unit configured to be moved between a pressing position where the pressing unit presses a surface of the sheet in the exposure state and a retreat position where the pressing unit retracts from the pressing position.

Further features of the present disclosure will become apparent from the following description of exemplary embodiments with reference to the attached drawings.

BRIEF DESCRIPTION OF THE DRAWINGS

FIG. 7 illustrates details of a sheet storage device control unit according to an exemplary embodiment.

DESCRIPTION OF THE EMBODIMENTS

Various exemplary embodiments will be described in detail below with reference to the drawings.

(Configuration of Image Forming Apparatus)

Figure 1:
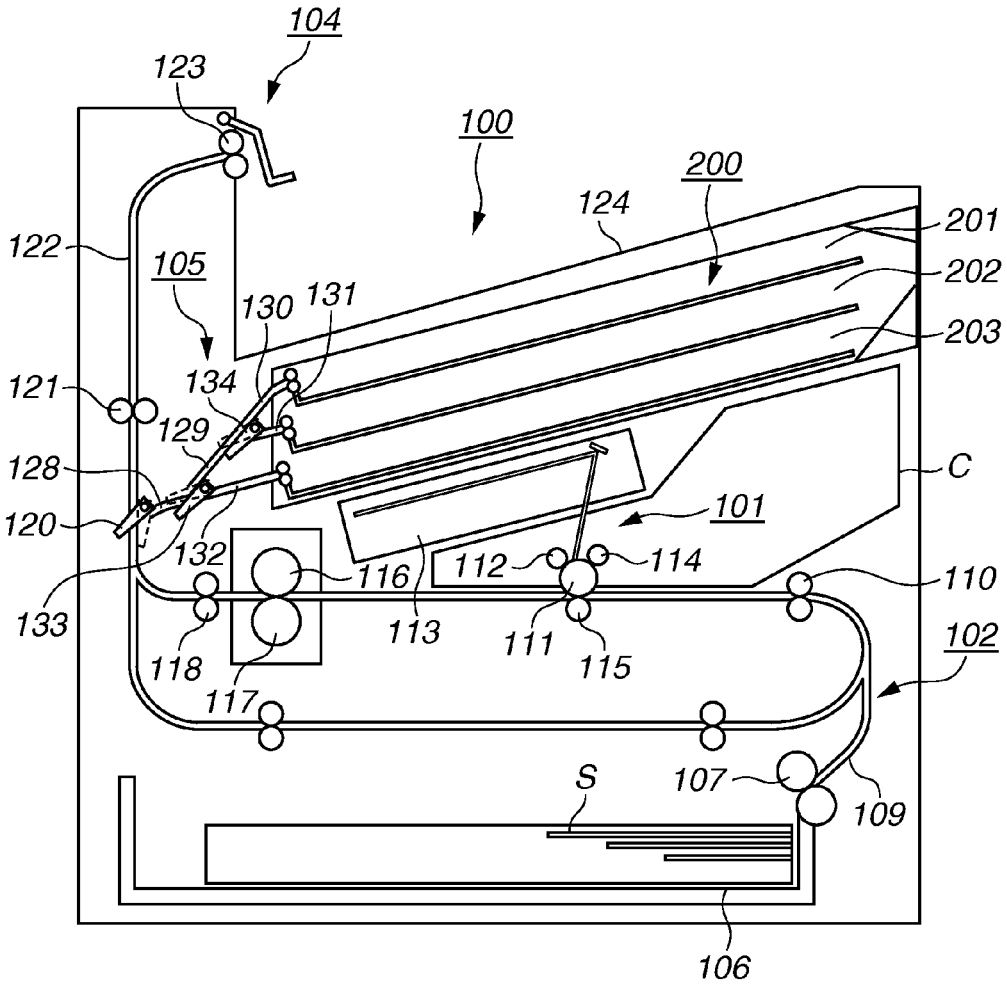
FIG. 1 illustrates a configuration of an image forming apparatus according to an exemplary embodiment.

FIG. 1 illustrates a configuration of an image forming apparatus that includes a sheet storage portion according to a first exemplary embodiment. In the present exemplary embodiment, an example of the image forming apparatus is a laser beam printer.

The image forming apparatus 100 includes an image forming unit 101, a feeding unit 102 configured to supply a sheet S to the image forming unit 101, and a discharge unit 104 configured to discharge the sheet S after an image has been formed by the image forming unit 101. In the present exemplary embodiment, the sheet S is, for example, a paper, an OHP sheet, a cloth, or the like. Further, a sheet storage device 200 is provided above the image forming unit 101. The sheet storage device 200 that includes a plurality of sheet storage portions 201 to 203, each of which can temporarily store an image-formed sheet S in the apparatus. Further, the image forming apparatus 100 includes a conveyance unit 105 configured to convey the image-formed sheet S to the sheet storage device 200.

The image forming unit 101 includes a photosensitive drum 111 that can rotate in the clockwise (CW) direction in FIG. 1, a charging roller 112 that can charge a surface of the photosensitive drum 111, and an exposure device 113 that can irradiate the photosensitive drum 111 with light to form an electrostatic latent image thereon. Further, the image forming unit 101 includes a developing device 114 that can apply toner particles to an electrostatic latent image to form a toner image on the photosensitive drum 111 and a transfer roller 115 that can transfer the toner image to a conveyed sheet S. Further, the image forming unit 101 includes a fixing roller 116, a pressing roller 117 that is brought into contact with the fixing roller 116, and a fixing discharging roller 118 to fix the transferred toner image on the sheet S. Through the above-mentioned image forming processes, the image forming unit 101 can form a toner image on each sheet S. In the image forming apparatus 100 according to the present exemplary embodiment, the photosensitive drum 111, the charging roller 112, the developing device 114, and a toner storing unit (not illustrated) that stores toner particles are integrated together as a cartridge C. The cartridge C is attachable to and detachable from the image forming apparatus. A user can replace the cartridge C by a new one if the toner amount of the cartridge C becomes smaller. Further, the type of the image forming apparatus 100 is not limited to the above-mentioned cartridge type. For example, the above-described embodiment is applicable to a non-cartridge type image forming apparatus that includes the photosensitive drum 111, the charging roller 112, and the developing device 114, as built-in members.

The feeding unit 102 includes a feeding cassette 106 that stores a plurality of stacked sheets S that can be used in image forming processing, a feeding roller 107, a conveyance guide 109, and a registration roller 110.

The discharge unit 104 includes a first switching member 120, a conveyance roller 121, a discharge guide 122, a discharge roller 123, and a discharge tray 124. An actuator (not illustrated) can switch the position of the first switching member 120 between a first position indicated by a solid line in FIG. 1 at which the first switching member 120 can guide the sheet S having been subjected to the image forming processing toward the sheet storage device 200 and a second position indicated by a dotted line at which the first switching member 120 can guide the sheet S toward the discharge tray 124. The discharge tray 124 is provided on an upper surface of the image forming apparatus 100 so that a plurality of users can commonly use the discharge tray 124. A face-down sheet with a lower surface on which an image is formed can be discharged to the discharge tray 124.

The conveyance unit 105 includes a second switching member 133 that can selectively change the conveyance destination of the sheet S, a third switching member 134, and conveyance guides 128 to 132 that can guide the sheets S to respective sheet storage portions 201 to 203. An actuator (not illustrated) can switch the position of the second switching member 133 between a position indicated by a solid line and a position indicated by a dotted line illustrated in FIG. 1. The position of the third switching member 134 can be switched similarly by an actuator (not illustrated). For example, when the sheet S is conveyed to the first sheet storage portion 201, the actuators move each of the second switching member 133 and the third switching member 134 to the position indicated by the solid line illustrated in FIG. 1. In this case, the sheet S passes through the conveyance guide 128 and the conveyance guides 129 and 130 sequentially and reaches the first sheet storage portion 201. Further, when the sheet S is conveyed to the second sheet storage portion 202, only the third switching member 134 is moved to the position indicated by the dotted line. In this case, the sheet S passes through the conveyance guides 128, 129, and 131 sequentially and reaches the second sheet storage portion 202. Similar to the discharge tray 124, the face-down sheet S can be stored in each of the sheet storage portions 201 to 203.

(Configuration of Sheet Storage Device)

Figure 2:
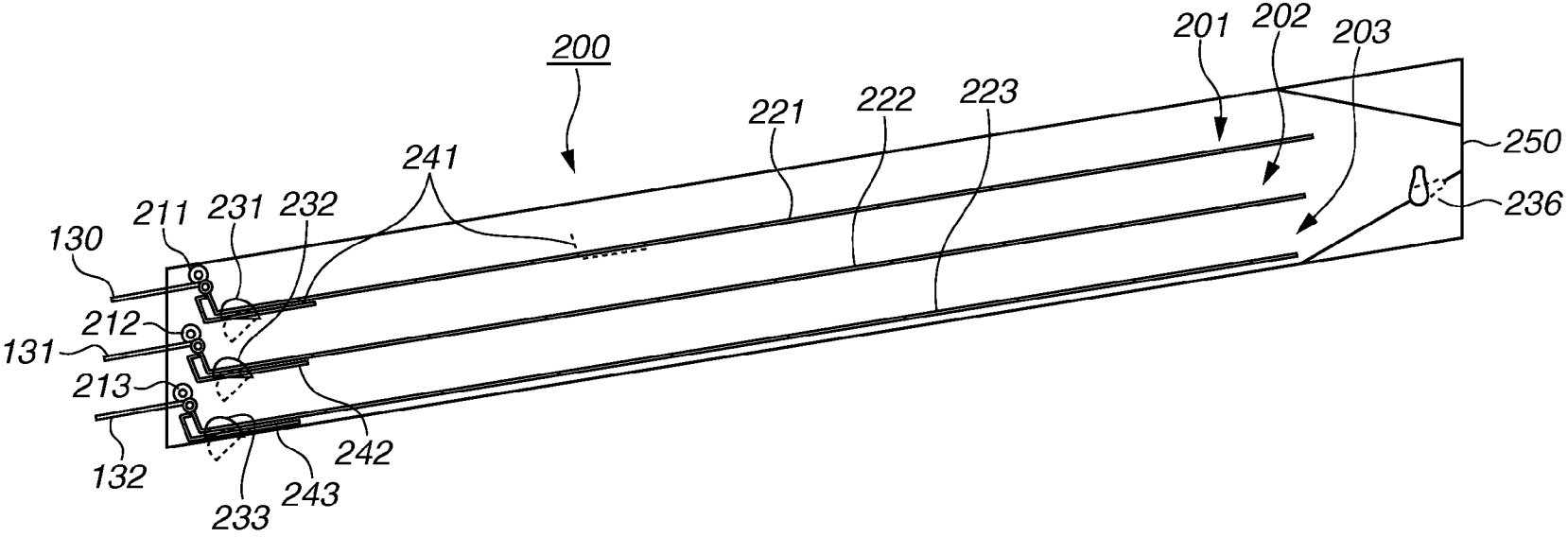
FIG. 2 illustrates a configuration of a sheet storage device according to an exemplary embodiment.

FIG. 2 illustrates a configuration of the sheet storage device 200. The sheet storage device 200 according to the present exemplary embodiment includes a plurality of sheet storage portions 201 to 203 that are sequentially stacked in the vertical direction. Each of the plurality of sheet storage portions has the same configuration. A configuration of the first sheet storage portion 201 is described in detail below.

The first sheet storage portion 201 includes a conveyance roller 211 that can convey each sheet S, a stacking tray 221 that can temporarily store a plurality of sheets S in a stacked state, and a sheet presence sensor 231 that can detect the presence of any sheet S in the stacking tray 221. Further, the first sheet storage portion 201 includes a moving unit 241 that can press the rear end of a stored sheet S (i.e., an upstream end portion of the sheet S in the conveyance direction) in such a way as to cause the front edge of the stored sheet S (i.e., a downstream end portion of the sheet S in the conveyance direction) to expose from the apparatus body of the image forming apparatus 100. The moving unit 241 moves the sheet S until the front edge of the sheet S passes through the opening 250 so that a user can receive the sheet S. Therefore, the sheet S exposes from the apparatus body by a predetermined length. In the present exemplary embodiment, the protruding length of the sheet S is set to be 30 mm. However, the protruding length of the sheet S can be set to any other length if it is appropriate for a user who grabs the exposed end of the sheet S in a state where the sheet S does not bend so greatly.

Further, the length of the stacking tray 221 is set to be sufficiently long so that the front edge of a sheet S having the maximum size storable in the first sheet storage portion 201 does not expose from the apparatus body. When a sheet S is placed on the stacking tray 221, the sheet presence sensor 231 moves to a position indicated by a dotted line at which the sheet presence sensor 231 turns on. When the sheet S is moved by the moving unit 241, the sheet presence sensor 231 returns to the original position indicated by a solid line at which the sheet presence sensor 231 turns off. Further, when the front edge of the moved sheet S pushes an opening sensor 236 provided adjacently to the opening 250, the opening sensor 236 moves to a position indicated by a dotted line at which the opening sensor 236 turns on. When the sheet S protruding partly from the apparatus body is removed, the opening sensor 236 returns to the original position indicated by a solid line at which the opening sensor 236 turns off. When sheets S are successively conveyed into the first sheet storage portion 201, the moving unit 241 is positioned at a stack position indicated by a solid line. On the other hand, when a stored sheet S is exposed from the apparatus body, the moving unit 241 moves toward the opening 250 along the conveyance path of the sheet S so that the sheet S can reach an exposure position indicated by a dotted line. The place where the sheet S is held in a exposed state, more specifically, the moving distance of the moving unit 241, can be determined based on the protruding length of the sheet S and the size of the sheet S in the conveyance direction.

Figure 3:
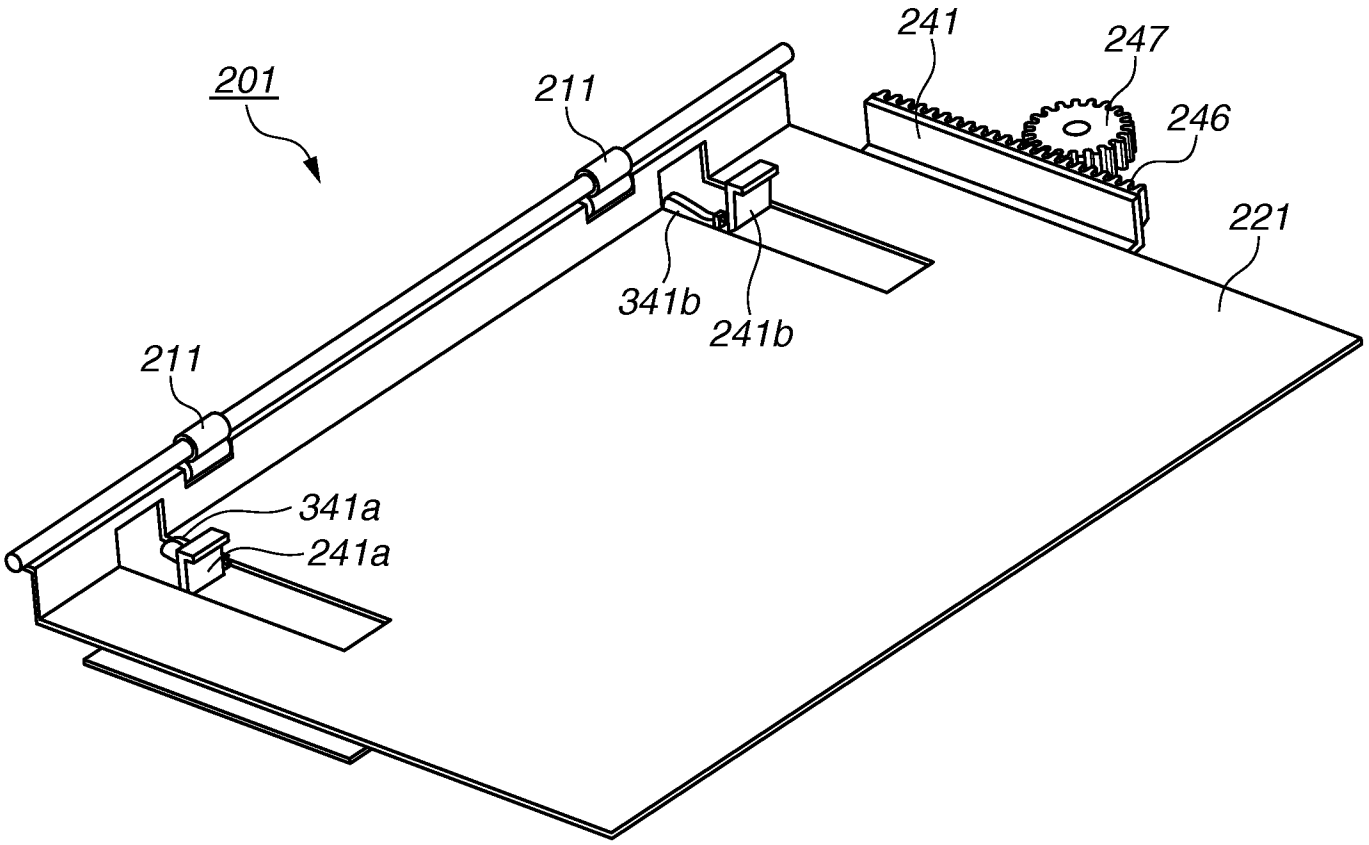
FIG. 3 is a perspective view illustrating a sheet storage portion according to an exemplary embodiment.

FIG. 3 is a perspective view illustrating the sheet storage portion 201. In FIG. 3, the moving unit 241 is positioned between the stack position and the exposure position. The moving unit 241 includes two sheet rear end pressing portions 241*a* and 241*b* that are separately provided in the width direction of the sheet S. Further, in the present exemplary embodiment, the moving unit 241 includes pressing members 341*a* and 341*b* that can press the surface of each sheet S. Further, the moving unit 241 includes a rack 246 that is integrally formed with the main body of the moving unit 241. The rack 246 can mesh with a pinion 247. In FIG. 3, the pinion 247 is connected to an actuator (not illustrated) that can serve as a driving unit. When the actuator is driven in the forward direction or in the reverse direction, the moving unit 241 can move in both directions between the stack position and the exposure position.

Figure 4:
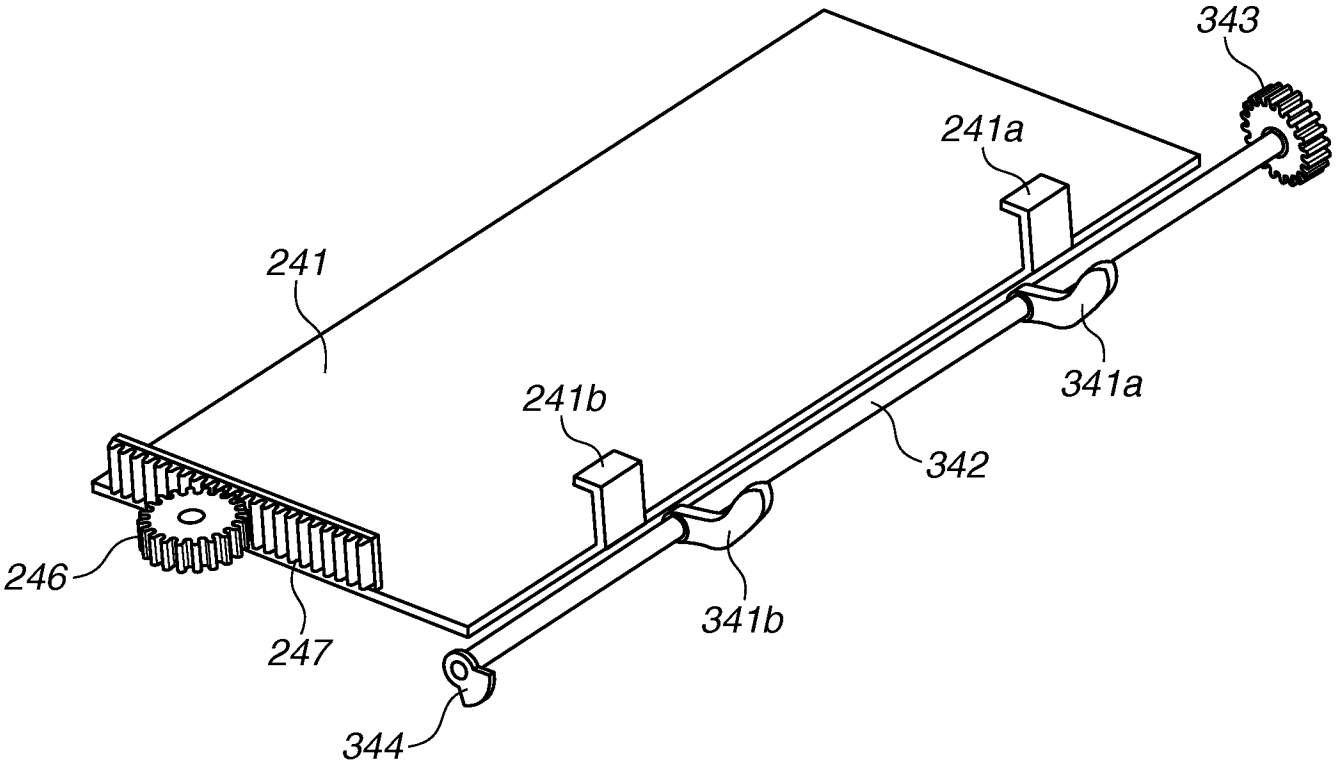
FIG. 4 is a perspective view illustrating a moving unit according to an exemplary embodiment.

FIG. 4 is a perspective view illustrating the moving unit 241, although the viewing direction is different from that of FIG. 3. The pressing members 341*a* and 341*b* can rotate around the central axis of the shaft 342. A gear 343 is provided at one end of the shaft 342. In FIG. 4, the gear 343 is connected to an actuator (not illustrated) that can serve as a driving unit. A sensor flag 344 is provided at the other end of the shaft 342. The sensor flag 344 is functionally operable as a position detection unit configured to cause the pressing members 341*a* and 341*b* to rotate and reach appropriate positions. The above-mentioned members including the actuators that rotate the pressing members 341*a* and 341*b* can move together with the moving unit 241 between the stack position and the exposure position.

Figure 5A:
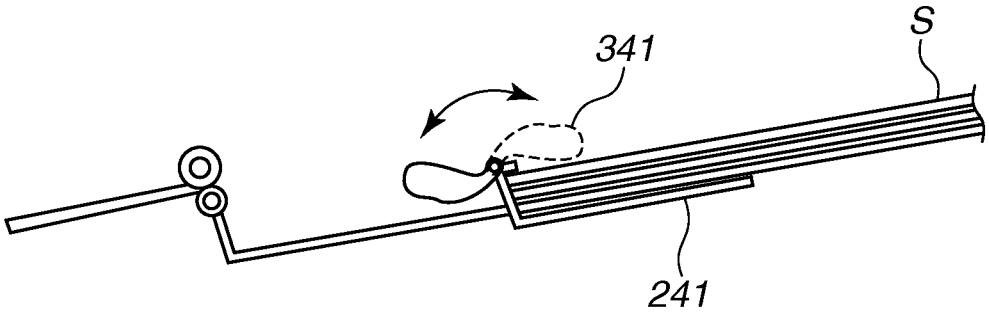
FIGS. 5A and 5B illustrate a pressing member and a position detection unit according to an exemplary embodiment.
Figure 5B:
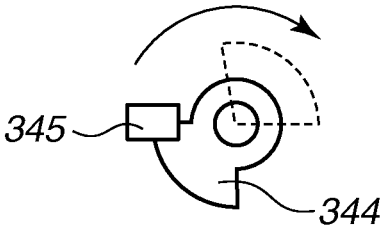

The position detection unit is described in detail below with reference to FIGS. 5A and 5B. As illustrated in FIG. 5A, the pressing member 341 can be positioned at a retreat position indicated by a solid line or a pressing position indicated by a dotted line when an actuator (not illustrated) rotates the pressing member 341 about its rotational axis via the gear 343. The actuator employed in the present exemplary embodiment is a stepping motor. When no sheet S is held, the pressing member 341 moves to the retreat position to prevent the pressing member 341 from interfering with a sheet S to be stacked. In other words, the pressing member 341 stays in the retreat position when a sheet S is conveyed to the stacking tray 221 by the conveyance roller 211. When there is a sheet S to be pressed and held, the pressing member 341 moves to the pressing position where pressing member 341 applies a predetermined pressure onto the rear end of the stored sheets S. Further, if the exciting phase of the stepping motor is fixed, the gear 343 can be fixed in a stationary state. Accordingly, in a state where the pressing member 341 holds the sheets S firmly under the applied pressing force, a user cannot take the sheet S out of the apparatus body even when the front edge of the sheet S is exposed through the opening 250.

In the present exemplary embodiment, the position detection unit is provided to cause the pressing member 341 to accurately move to the retreat position and the pressing position. FIG. 5B illustrates the sensor flag 344 and a photo interrupter 345 that cooperatively function as the position detection unit. When the pressing member 341 reaches the retreat position where the pressing member 341 does not hold any sheet S, the sensor flag 344 moves to a home position indicated by a solid line and the photo interrupter 345 turns off. When the pressing member 341 reaches the pressing position where the pressing member 341 presses and holds the sheet S, the sensor flag 344 moves to a position indicated by a dotted line and the photo interrupter 345 turns on.

Further, in the present exemplary embodiment, the pressing position can be changed according to the number of stored sheets S so that the pressing member 341 can appropriately hold the rear end of the stacked sheets S while applying a predetermined pressure to the sheets S. Therefore, the pressing member 341 is constituted in such a way as to hold the rear end of sheets S when the number of the sheets S is a maximum value that can be stored in the sheet storage portion 201 at the time when the photo interrupter 345 changes from the OFF state to the ON state. Further, a driving continuation time to be provided after the turning-on of the photo interrupter 345 is controlled according to the number of the stored sheets S. More specifically, the driving continuation time is increased when the number of the sheets S is small compared to a case where the number of stored sheets S is large. Therefore, the pressing member 341 can hold a plurality of sheets S appropriately regardless of the number of the sheets S.

(Control Unit and Functional Configuration)

Figure 6:
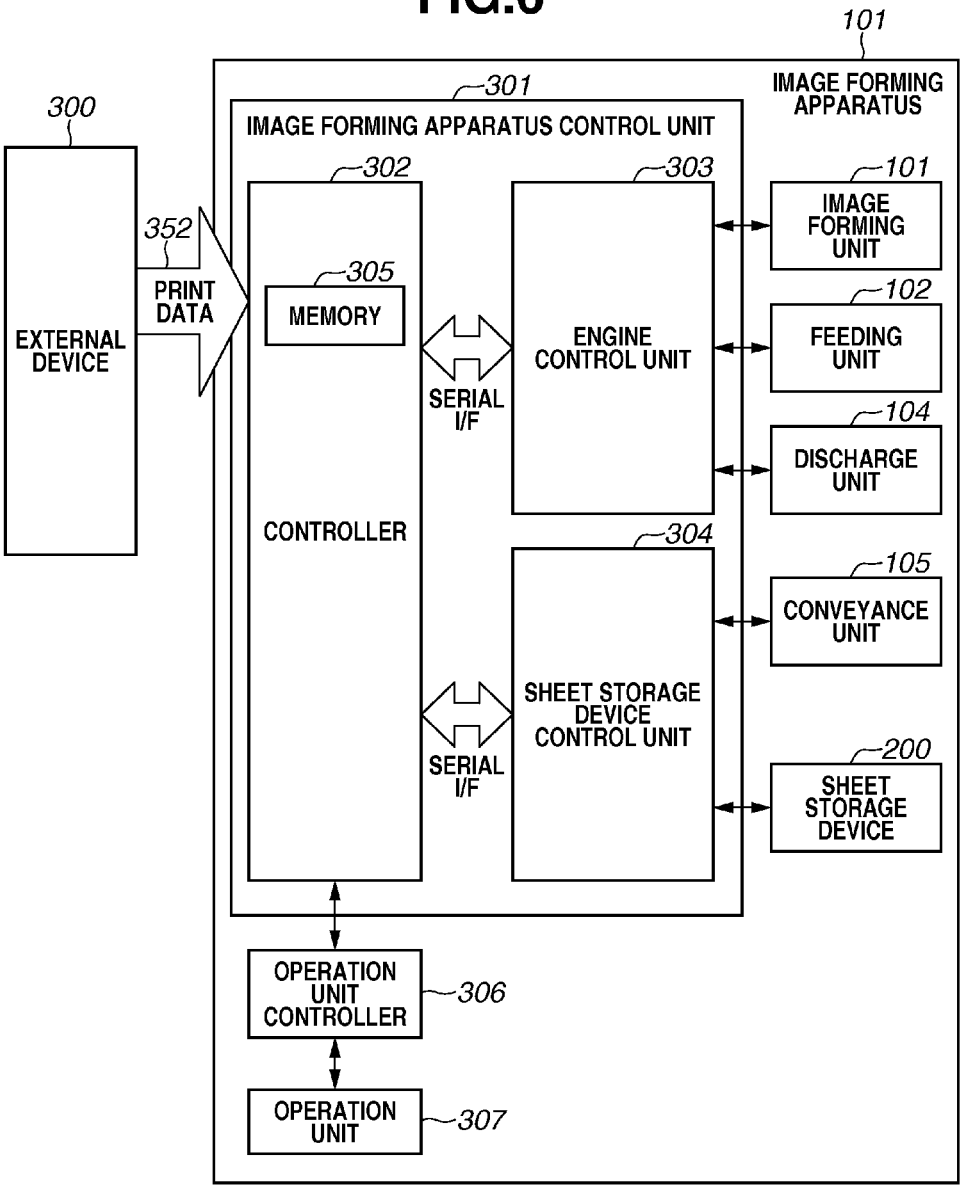
FIG. 6 is a block diagram illustrating a control unit and a functional configuration of the image forming apparatus according to an exemplary embodiment.

FIG. 6 is a block diagram illustrating a control unit and a functional configuration according to the present exemplary embodiment. The image forming apparatus 100 includes an image forming apparatus control unit 301 that is functionally operable as the control unit. The image forming apparatus control unit 301 includes a controller 302, an engine control unit 303, and a sheet storage device control unit 304.

The controller 302 can communicate with an external device 300 (e.g., a host computer) to receive print data 352 and can store the received print data 352 in a memory 305 (e.g., a random access memory (RAM)). The controller 302 can analyze the print data 352 stored in the memory 305 to generate print conditions. For example, the print conditions include information about the total number of sheets S that can be supplied, a discharge destination of a printed image-formed sheet S, and the density of an image to be printed. Further, the controller 302 can transmit a designation about the print conditions generated based on the print data 352 to the engine control unit 303 via a serial I/F. The engine control unit 303 can control each mechanism according to the print conditions received from the controller 302. More specifically, the controller 302 can control the image forming unit 101 to form an image on a sheet S and can control the feeding unit 102 and the discharge unit 104 to feed and discharge the sheet S.

Further, the controller 302 can analyze the print data 352 stored in the memory 305 to generate sheet storing conditions and discharge conditions for respective sheet storage portions 201 to 203. Then, the controller 302 can transmit a designation about the sheet storing conditions and the discharge conditions generated based on the print data 352 to the sheet storage device control unit 304 via a serial I/F. For example, the sheet storing conditions include information about a storing destination of a printed image-formed sheet S and the number of sheets S to be stored. Further, the discharge conditions include information about the moving distances of respective moving units 241 to 243 that are required to cause each sheet S to expose beyond the opening 250. The sheet storage device control unit 304 can control each mechanism according to the sheet storing conditions and the discharge conditions received from the controller 302. More specifically, the sheet storage device control unit 304 can control the conveyance unit 105 to convey each printed image-formed sheet to one of the sheet storage portions 201 to 203, and can control the sheet storage device 200 including the moving unit 241 to cause a sheet stored in each one of the sheet storage portions 201 to 203 to move to the opening 250. Further, the image forming apparatus 100 includes an operation unit controller 306 that is configured to perform a control to notify the controller 302 of various settings and a discharge instruction entered by a user via an operation unit 307.

(Details of Sheet Storage Device Control Unit)

FIG. 7 illustrates details of the sheet storage device control unit 304 according to the present exemplary embodiment. The sheet storage device control unit 304 includes a central processing unit (CPU) 350, which can communicate with the controller 302 via a serial communication unit 351. The serial communication unit 351 connects the CPU 350 and the controller 302 with a plurality of signal lines. In the present exemplary embodiment, three signal lines for the serial communication are dedicated to a conveyance notification signal 353, a storage destination signal 354, and a discharge instruction signal 357, as described in detail below.

A control to be performed when a sheet S is stored in the sheet storage device 200 is described in detail below. When the controller 302 receives the print data 352 via the external device 300, the controller 302 temporarily stores the print data 352 in the memory 305. Subsequently, the controller 302 analyzes the stored print data 352 and transmits the conveyance notification signal 353 and the storage destination signal 354 to the CPU 350 via the serial communication unit 351. The CPU 350 controls each actuator described below based on the notified signals and conveys printed sheets S to respective sheet storage portions 201 to 203.

Next, a control to cause the sheet S to expose from the sheet storage device 200 is described in detail below. When a user instructs a discharge operation of a sheet S from the sheet storage portion via the external device 300 or the operation unit 307, the discharge instruction signal 357 is transmitted to the controller 302. After the controller 302 determines a discharge target sheet storage portion, the controller 302 transmits the discharge instruction signal 357 to the CPU 350 via the serial communication unit 351 and instructs a discharge operation by the designated sheet storage portion. The CPU 350 controls each actuator in such a way as to expose the sheet S of the notified sheet storage portion beyond the opening 250.

Next, various actuators connected to the CPU 350 are described in detail below.

A motor driver 358 is connected to an output terminal of the CPU 350. The motor driver 358 can drive a conveyance motor 359. When the conveyance motor 359 rotates, the conveyance rollers 211, 212, and 213 rotate correspondingly and convey the sheets S to respective sheet storage portions 201 to 203.

A motor driver 360 is connected to an output terminal of the CPU 350. The motor driver 360 can drive a discharge motor 361. When the discharge motor 361 rotates in the clockwise (CW) direction, the moving unit 241 of the first sheet storage portion 201 moves toward the opening 250. When the discharge motor 361 rotates in the counterclockwise (CCW) direction, the moving unit 241 of the first sheet storage portion moves toward the home position that is opposed to the opening 250. Similarly, motor drivers 362 and 364 are connected to output terminals of the CPU 350 to drive discharge motors 363 and 365. The discharge motor 363 controls the moving unit 242 of the second sheet storage portion 202. The discharge motor 365 controls the moving unit 243 of the third sheet storage portion 203.

The sheet presence sensor 231 includes a pull-up resistor 366 and a buffer 367 to input information indicating whether the first sheet storage portion 201 stores a sheet S to the CPU 350. Similarly, the sheet presence sensor 232 can input information indicating whether the second sheet storage portion 202 stores a sheet S to the CPU 350. The sheet presence sensor 233 can input information indicating whether the third sheet storage portion 203 stores a sheet S to the CPU 350.

The opening sensor 236 includes a pull-up resistor 375 and a buffer 376 to input information indicating whether a sheet S exposes from the apparatus body beyond the opening 250 to the CPU 350.

An actuator capable of switching the second switching member 133 is connected to an output terminal of the CPU 350. When the actuator is an ON state, the second switching member 133 is switched in such a way as to convey the sheet S toward a conveyance guide 129. When the actuator is in an OFF state, the second switching member 133 is switched in such a way as to convey the sheet S toward a conveyance guide 132. Similarly, an actuator capable of switching the third switching member 134 is connected to an output terminal of the CPU 350. When the actuator is in an ON state, the third switching member 134 is switched in such a way as to convey the sheet S toward a conveyance guide 130. When the actuator is in an OFF state, the third switching member 134 is switched in such a way as to convey the sheet S toward a conveyance guide 131.

A motor driver 366 is connected to an output terminal of the CPU 350. The motor driver 366 drives a switching motor 367. When the switching motor 367 rotates in the clockwise (CW) direction, the pressing member 341 of the first sheet storage portion 201 rotates toward the pressing position. When the switching motor 367 rotates in the counterclockwise (CCW) direction, the pressing member 341 of the first sheet storage portion 201 rotates toward the retreat position. Similarly, motor drivers 368 and 370 are connected to output terminals of the CPU 350 to drive the switching motors 367 and 371, respectively. The switching motor 367 controls a pressing member 346 of the second sheet storage portion 202. The switching motor 371 controls a pressing member 347 of the third sheet storage portion 203.

(Operation of Sheet Storage Device)

Figure 8:
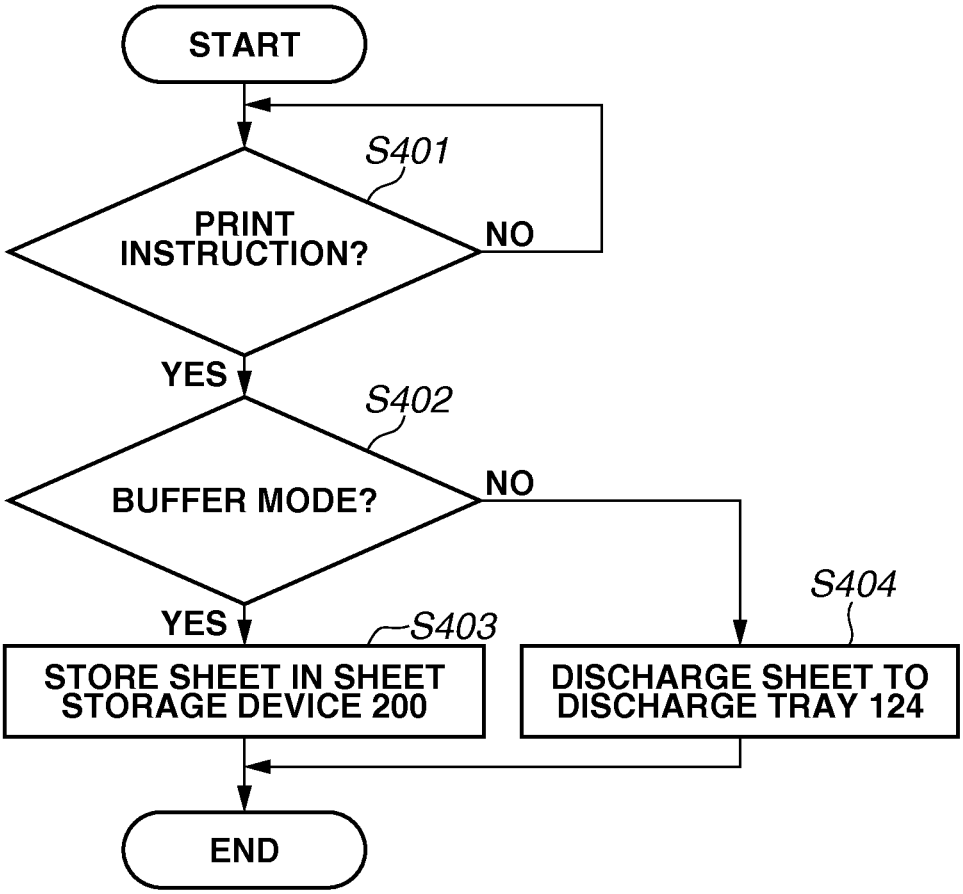
FIG. 8 is a flowchart illustrating a sheet printing operation according to an exemplary embodiment.

In the above-mentioned image forming apparatus, a user can select either a buffer mode or an ordinary mode via the external device 300 or the operation unit 307. In the buffer mode, the image forming apparatus temporarily stores a sheet S in the sheet storage device 200. In the ordinary mode, the image forming apparatus discharge a sheet S to the discharge tray 124. The selected mode can be stored in the memory 305. FIG. 8 is a flowchart illustrating a control to be performed when a user instructs printing on the sheet S. To realize the control based on the flowchart illustrated in FIG. 8, the controller 302 illustrated in FIG. 6 executes a program stored in the memory 305.

First, if a user instructs the printing on the sheet S via the external device 300 (YES in step S401), the controller 302 receives the print data 352. If the reception of the print data 352 completes, then in step S402, the controller 302 confirms whether the selected mode is the buffer mode with reference to the information stored in the memory 305. If the selected mode is the buffer mode (YES in step S402), then in step S403, the controller 302 temporarily store the sheet S in the sheet storage device 200. If the selected mode is the ordinary mode (NO in step S402), then in step S404, the controller 302 discharges the sheet S to the discharge tray 124. Then, the controller 302 terminates the control according to the flowchart illustrated in FIG. 8. Further, in the flowchart illustrated in FIG. 8, a user is allowed to select a mode beforehand. However, the content of the flowchart is not limited to the above-mentioned example. For example, it is useful to allow a user to select either one of these modes each time when the user instructs printing.

Next, an operation of the sheet storage device 200 to be performed in step S403 is described in detail below. In the present exemplary embodiment, when a plurality of sheets S is stored in the sheet storage device 200, each sheet S is distributed to one of the sheet storage portions according to the job number of the sheet S. Further, when a user instructs a discharge operation of a sheet S from the sheet storage device 200, the sheet S belonging to the user is exposed from the apparatus body beyond the opening 250. In generating a discharge instruction, the user can input a password having been set beforehand via the external device 300 or the operation unit 307. Alternatively, it is useful to cause an ID card reading unit (not illustrated) provided in the operation unit 307 to read a user's ID card to perform user authentication in the generation of the discharge instruction. In the present exemplary embodiment, as mentioned above, individual actuators that drive the moving units 241 to 243 are provided in respective sheet storage portions 201 to 203. Accordingly, even when the sheets S stored in a plurality of sheet storage portions belong to the same user, the user can receive the sheets S together by driving these actuators. Further, the job number of the sheet S and information about each user who has instructed the printing on the sheet S are stored in the memory 305 provided in the controller 302. The controller 302 identifies a discharge target sheet S with reference to the data stored in the memory 305 in response to a discharge instruction from a user. Then, the controller 302 instructs the sheet storage device 200 to discharge the target sheet S.

Figures 9A, 9B:
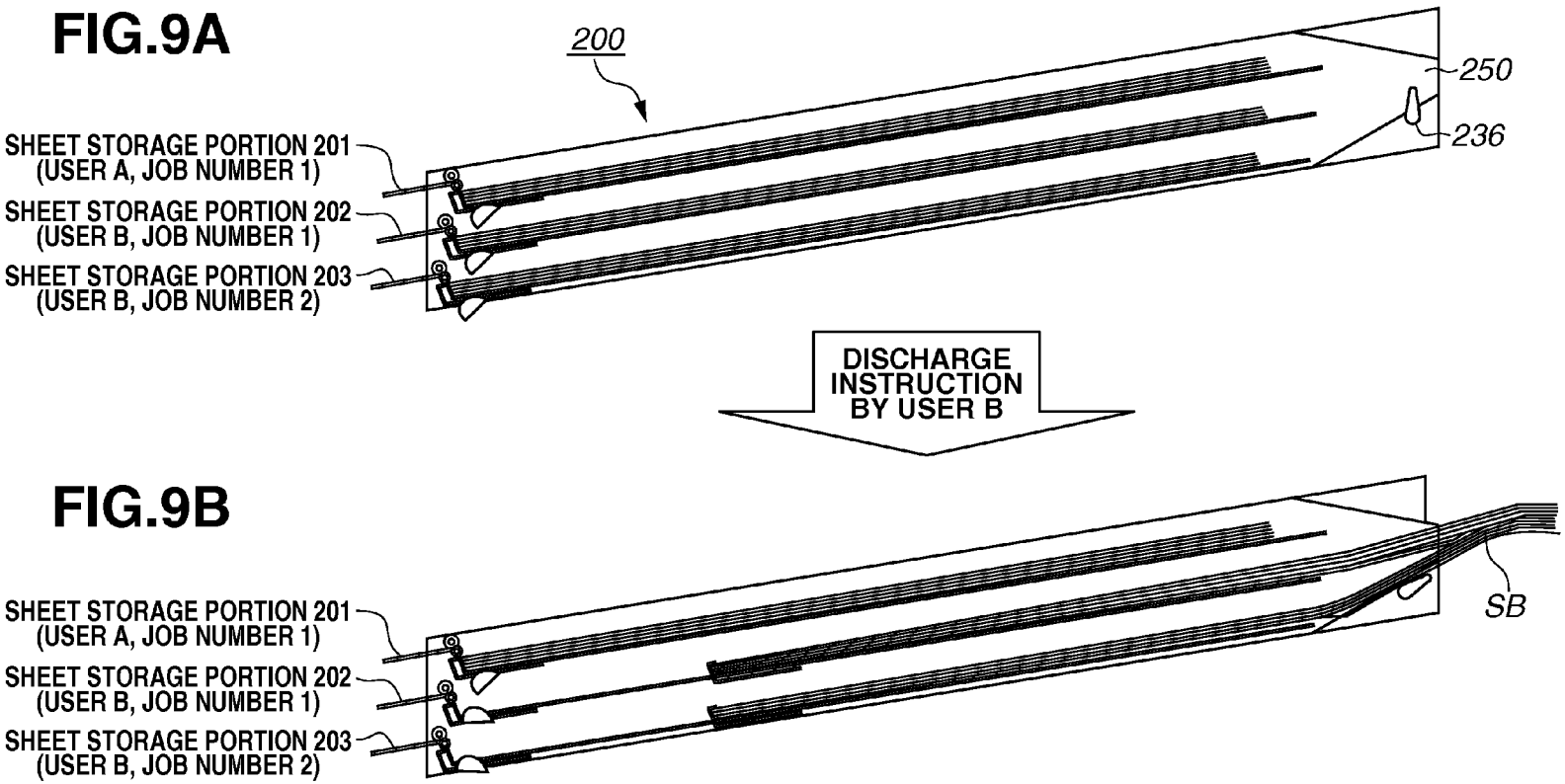
FIGS. 9A and 9B illustrate operational states of the sheet storage device in a sheet protruding operation according to an exemplary embodiment.

FIGS. 9A and 9B illustrate operational states of the sheet storage device 200. In FIG. 9A, each sheet S stored in the sheet storage portion 201 has a job number 1 and belongs to a user A. Each sheet S stored in the sheet storage portion 202 has a job number 1 and belongs to a user B. Each sheet S stored in the sheet storage portion 203 has a job number 2 and belongs to the user B. As illustrated in FIG. 9B, in response to an instruction to discharge the sheets S of the user B, the moving units 242 and 243 of the sheet storage portions 202 and 203 move toward the opening 250 to cause a sheet bundle SB to expose beyond the opening 250.

Figure 10:
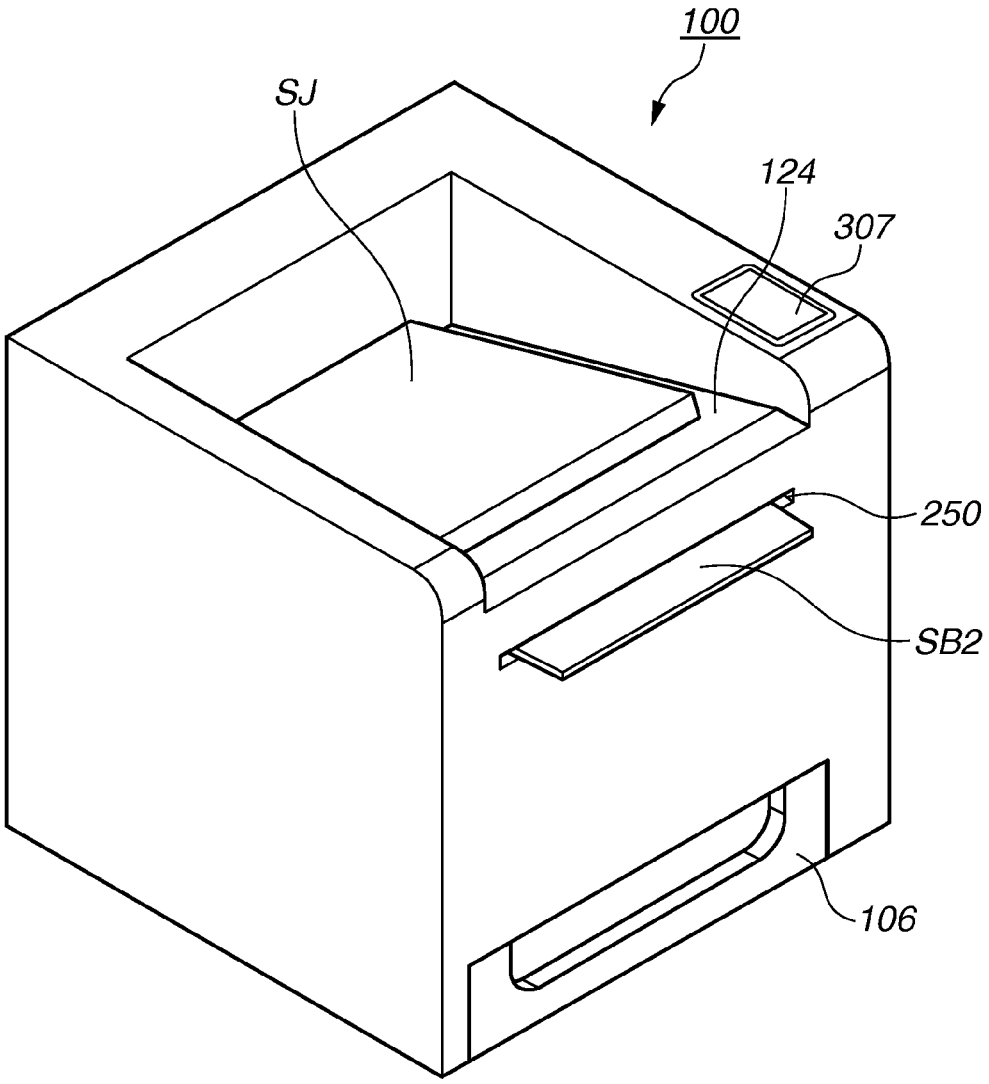
FIG. 10 is a perspective view illustrating the image forming apparatus in the sheet protruding operation according to an exemplary embodiment.

FIG. 10 is a perspective view illustrating the image forming apparatus 100 in the state where the sheet bundle SB is exposed through the opening 250. A sheet bundle SJ including printed sheets belonging to a plurality of users is stacked on the discharge tray 124. A front edge SB2 of the sheet bundle SB, which is supplied from the sheet storage portions 202 and 203, is exposed through the opening 250. A user can pick up the sheet bundle SB by grabbing and pulling the front edge SB2 protruding from the apparatus body.

Further, if the number of sheets S that are instructed by a user to store in a specific sheet storage portion is greater than the maximum number of sheets that can be stored in the designated sheet storage portion, the sheet S can be partly distributed to a different sheet storage portion even though the job number is the same. For example, in FIG. 9A, the sheets S of the user B having the job number 1 are stored in the sheet storage portion 202 and the sheets S of the user B having the job number 2 are stored in the sheet storage portion 203. However, when the number of sheets having the job number 1 is greater than the maximum number of sheets that can be stored in the sheet storage portion 202, a part of the sheets S having the job number 1 can be distributed to the sheet storage portion 203 if there is not any other sheet S stored in the sheet storage portion 203.

In the present exemplary embodiment, the sheet storage device 200 is surrounded by a casing except for the opening 250 that enables the stored sheet S to expose from the apparatus body. Accordingly, in a state where the sheets S are stored in respective sheet storage portions 201 to 203, each user cannot see the printed information on each sheet S in respective sheet storage portions. Therefore, each user can prevent the printed information on its own sheet S from being known by other users. In other words, the confidentiality of information can be enhanced.

On the other hand, for the purpose of enhancing the confidentiality of information, the image forming apparatus can be modified to start image forming processing after performing user authentication using an ID card or the like. However, compared to the above-mentioned modified apparatus, the image forming apparatus 100 according to the present exemplary embodiment requires only performing an operation to expose the printed image-formed sheet S from respective sheet storage portions 201 to 203. Accordingly, each user can quickly take out the sheet S after completing the user authentication, without waiting for the time to form an image.

Further, when a user instructs the image forming apparatus 100 to perform a discharge operation, the user can take out only the own sheets. Thus, the user is not required to find out the user's own sheets from the discharge tray 124, although the user's own sheets and other user's sheets are stacked in a mixed state.

(Control to be Performed when Sheet Remains at Opening)

Figure 11:
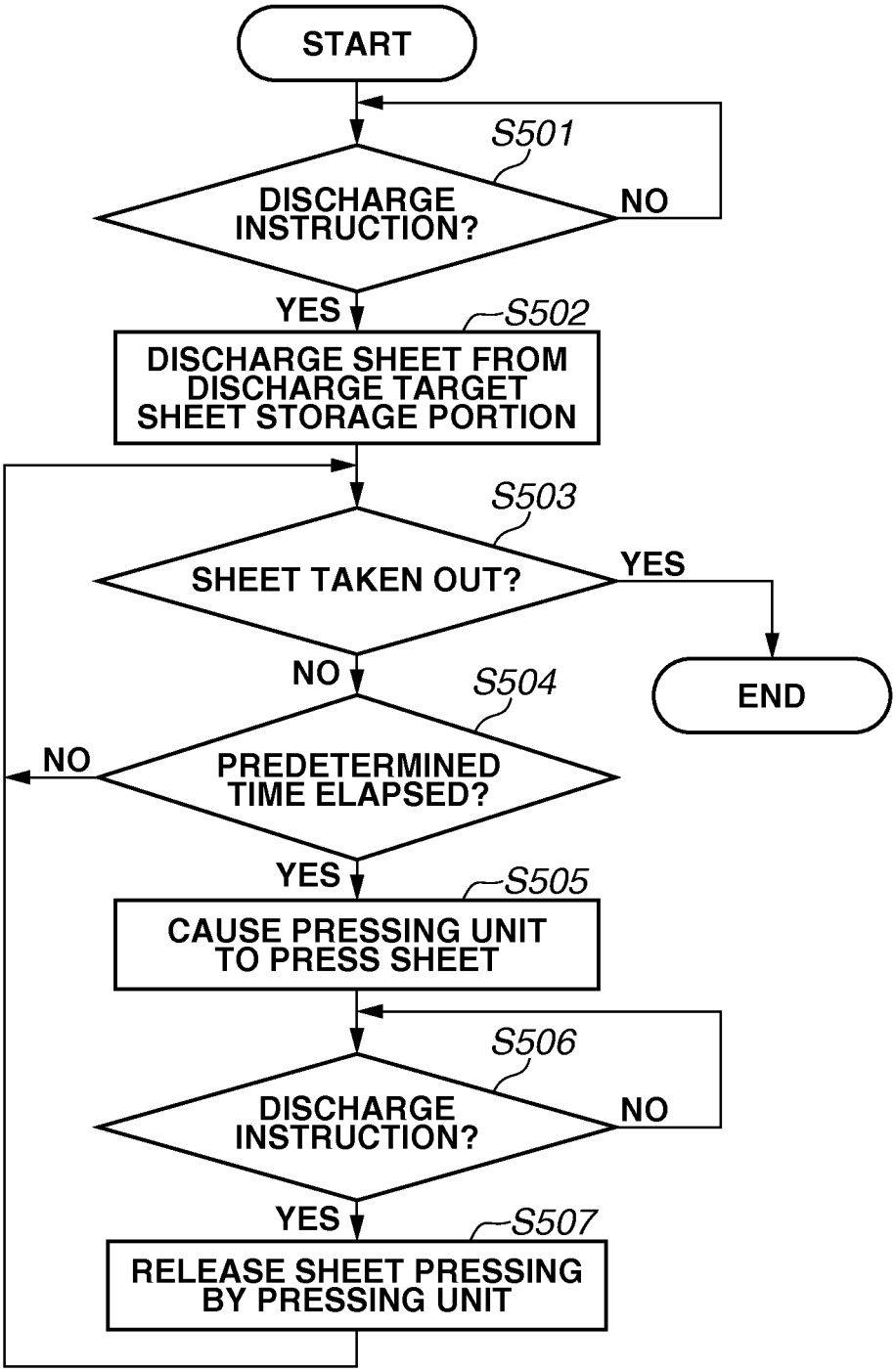
FIG. 11 is a flowchart illustrating a control that can be performed in a state where a sheet is left according to the first exemplary embodiment.

A control method that can be performed by the above-mentioned image forming apparatus according to an exemplary embodiment is described in detail below. In the present exemplary embodiment, a user instructs the image forming apparatus to perform a discharge operation in a state where a sheet S is partly exposed beyond the opening 250 and left for a long time (for example, when the user forgets to pick up the sheet S). FIG. 11 is a flowchart illustrating a control according to the present exemplary embodiment. To realize the control based on the flowchart illustrated in FIG. 11, the controller 302 illustrated in FIG. 6 executes a program stored in the memory 305.

First, if a user instructs a discharge operation of a sheet S from the sheet storage device 200 via the external device 300 or the operation unit 307 (YES in step S501), the discharge instruction signal 357 is transmitted to the controller 302. In step S502, the controller 302 determines a discharge target sheet storage portion in response to the discharge instruction signal 357. The controller 302 causes a sheet S stored in the discharge target sheet storage portion to expose from the apparatus body beyond the opening 250. Next, in step S503, the controller 302 determines whether the exposed sheet S has been taken out of the apparatus body based on a detection result of the opening sensor 236 obtained via the sheet storage device control unit 304. The sheet storage device control unit 304 can identify the taken-out state of the sheet S in response to a change of the opening sensor 236 from the ON state to the OFF state. If it is determined that the sheet S has been taken out (YES in step S503), the controller 302 terminates the control based on the flowchart illustrated in FIG. 11. On the other hand, if it is determined that the sheet S has not been taken out (NO in step S503), then in step S504, the controller 302 confirms whether a predetermined time has elapsed after the sheet S has been exposed. In the present exemplary embodiment, the predetermined time is set to one minute and a setting value of the predetermined time is stored in the memory 305. The user is allowed to change the predetermined time via the operation unit 307. If it is determined that the predetermined time (i.e., one minute) has not yet elapsed since the protrusion timing of the sheet S (NO in step S504), the operation of the controller 302 returns to step S503 to repeat the determination flow. If it is determined that the predetermined time (i.e., one minute) has elapsed since the protrusion timing of the sheet S (YES in step S504), then in step S505, the controller 302 causes the pressing member corresponding to the exposed sheet S to move to the pressing position. In other words, the controller 302 prevents the exposed sheet S from being picked up by the user. At this moment, it is useful to display an appropriate message on a screen of the external device 300 or the operation unit 307. For example, the message content to be displayed in this case indicates that the predetermined time has elapsed and picking up the sheet S via the opening 250 is currently prohibited. It is also useful to display a user name together with the above-mentioned message to inform the user who has instructed the printing on the exposed sheet S. Subsequently, if the user instructs the discharge operation again (YES in step S506), then in step S507, the controller 302 causes the pressing member to move to the retreat position so that the sheet S can be taken out.

As mentioned above, if the sheet S is not taken out from the opening 250 even when the predetermined time has elapsed since the protrusion timing of the sheet S, the pressing member holds the sheet S. Accordingly, it is feasible to prevent the sheet S from being taken out by other user when the sheet is left without being picked up by a user.

In the first exemplary embodiment, it is determined whether to hold the sheet S after the predetermined time has elapsed since the protrusion timing of the sheet S. However, for example, it is useful to provide a human body detection sensor (not illustrated) in the image forming apparatus 100. The human body detection sensor is capable of detecting the presence of a neighboring person. In this case, it is useful to determine whether to hold the sheet S based on a detection result of the human body detection sensor. The human body detection sensor is, for example, an infrared ray sensor. A control using the human body detection sensor is described below. When a user operates the operation unit 307 to instruct a discharge operation of the sheet S, the moving unit moves the sheet S to the outside beyond the opening 250. In this case, the human body detection sensor turns on because the user is present in the vicinity of the apparatus body. If the human body detection sensor turns off in a state where the sheet has not been taken out from the opening 250, it means that the user departed from the apparatus without picking up the exposed sheet S. To this end, the pressing member holds the sheet S to prevent the exposed sheet S from being taken out by other users. Such a control can be realized by replacing step S504 of the flowchart illustrated in FIG. 11 by a step of determining whether the human body detection sensor is ON or OFF. In this case, if the human body detection sensor is continuously ON in step S504, the operation returns to step S503. Further, if the human body detection sensor is OFF, the operation proceeds to step S505.

In the first exemplary embodiment, the pressing member holds a sheet S if the predetermined time elapses after a user instructs the image forming apparatus to perform a discharge operation. In a second exemplary embodiment, a control that can be performed when another user instructs a discharge operation in a state where a sheet S is partly exposed beyond the opening 250 after a user instructs the image forming apparatus to perform a discharge operation is described in detail below. Most of constituent components according to the present exemplary embodiment are similar to those described in the first exemplary embodiment. Therefore, only a part that is different from that described in the first exemplary embodiment is described in detail below.

Figure 12:
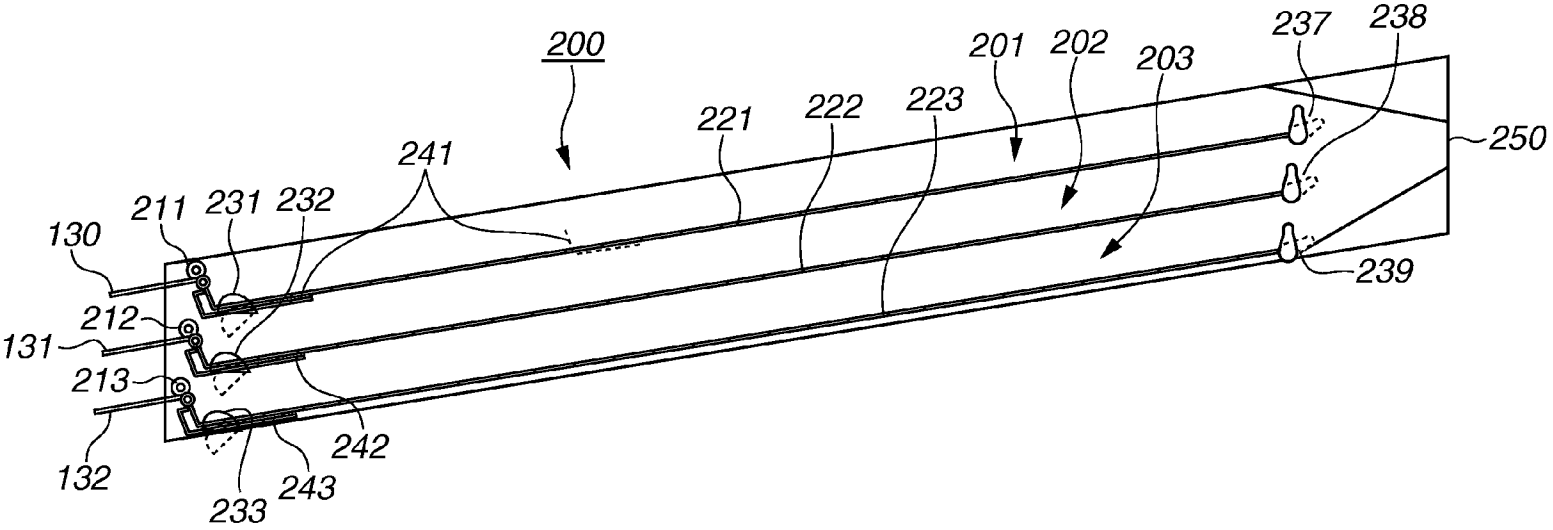
FIG. 12 illustrates a configuration of a sheet storage device according to a second exemplary embodiment.

FIG. 12 illustrates a configuration of a sheet storage device 200 according to the present exemplary embodiment, which is different from the sheet storage device 200 described in the first exemplary embodiment in that the opening sensor 236 is replaced by three sensors 237 to 239. The sensors 237 to 239 are provided in the sheet storage portions 201 to 203, respectively, at a position adjacent to the opening 250. These sensors 237 to 239 generate detection results that can be used to detect whether the exposed sheet S has been taken out from respective sheet storage portions 201 to 203. Further, the detection results of these sensors 237 to 239 can be used to adjust a length of the sheet S protruding beyond the opening 250.

Figure 13:
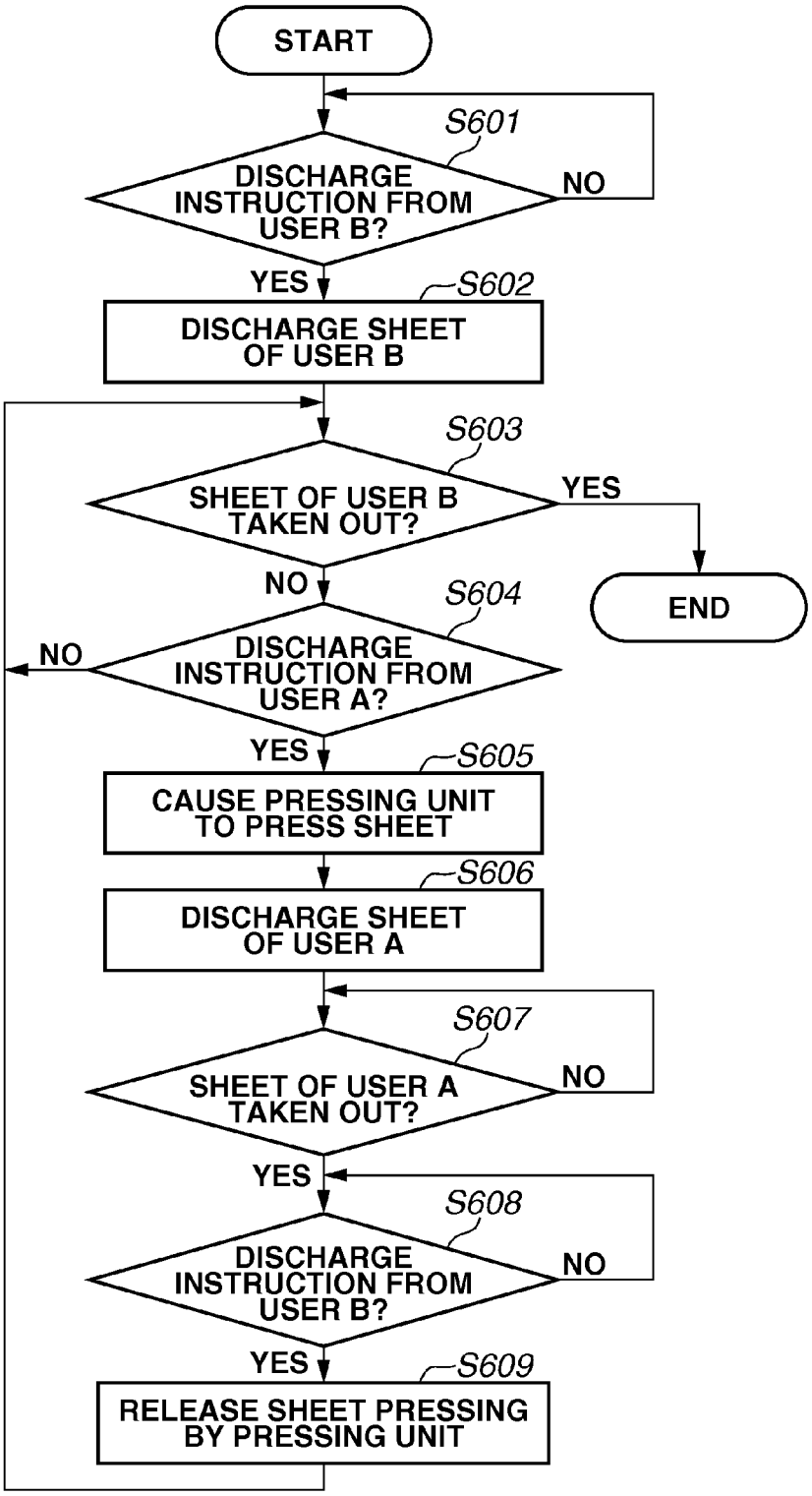
FIG. 13 is a flowchart illustrating a control that can be performed in a state where a sheet is left according to the second exemplary embodiment.

FIG. 13 is a flowchart illustrating a control according to the present exemplary embodiment. To realize the control based on the flowchart illustrated in FIG. 13, the controller 302 illustrated in FIG. 6 executes a program stored in the memory 305.

First, if the user B operates the external device 300 or the operation unit 307 to instruct discharging the sheet S of the user B from the sheet storage device 200 (YES in step S601), the discharge instruction signal 357 is transmitted to the controller 302. If the discharge instruction signal 357 has been received (YES in step S601), then in step S602, the controller 302 determines a discharge target sheet storage portion and causes the sheet S of the user B to expose from the apparatus body beyond the opening 250. Next, in step S603, the controller 302 determines whether the exposed sheet S of the user B has been taken out based on detection results of the sensors 237 to 239 obtained via the sheet storage device control unit 304. The sheet storage device control unit 304 can identify the taken-out state of the sheet S in response to a change of respective sensors 237 to 239 from the ON state to the OFF state. If it is determined that the sheet S has been taken out (YES in step S603), the controller 302 terminates the control of the flowchart illustrated in FIG. 13. On the other hand, if it is determined that the sheet S has not been taken out (NO in step S603), then in step S604, the controller 302 confirms whether a sheet discharge instruction has been received from another user. In the present exemplary embodiment, if the discharge instruction has not been received from the user A (i.e., a user different from the user B) (NO in step S604), the operation of the controller 302 returns to step S603 to repeat the determination flow. If it is determined that the discharge instruction has been received from the user A (YES in step S604), then in step S605, the controller 302 causes the pressing member corresponding to the exposed sheet S of the user B to move to the pressing position. In other words, the controller 302 prevents the exposed sheet S of the user B from being taken out. At this moment, it is useful to display an appropriate message on the screen of the external device 300 or the operation unit 307. For example, the message content to be displayed in this case indicates that picking up the sheet S of the user B via the opening 250 is currently prohibited because the discharge instruction has been received from the user A. Subsequently, in step S606, the controller 302 causes the sheet S of the user A to expose from the apparatus body beyond the opening 250. Next, in step S607, the controller 302 determines whether the exposed sheet S of the user A has been taken out based on a detection result of the sensors 237 to 239 obtained via the sheet storage device control unit 304. If it is determined that the sheet S has been taken out (YES in step S607), then in step S608, the controller 302 determines whether the discharge instruction has been received from the user B again. If it is determined that the discharge instruction has been received from the user B (YES in step S608), then in step S609, the controller 302 moves the pressing member to the retreat position so that the sheet S of the user B can be taken out.

It is useful to move the pressing member to the retreat position so that the sheet S of the user B can be taken out if the predetermined time has not yet elapsed after the user B has instructed the discharge operation of the sheet S. More specifically, the controller 302 can cause the pressing member to move to the retreat position before the user B instructs the discharge operation again in step S608 (for example, at the completion timing of the operation for protruding sheet S of the user A in step S606). Thus, it is feasible to solve the problem that the user B cannot take out the sheet S through the opening 250 even though the user B has performed an action to pick up the sheet S without delay, for example, when the user A instructs a discharge operation immediately after the user B instructs the discharge operation.

Figures 14A, 14B, 14C:
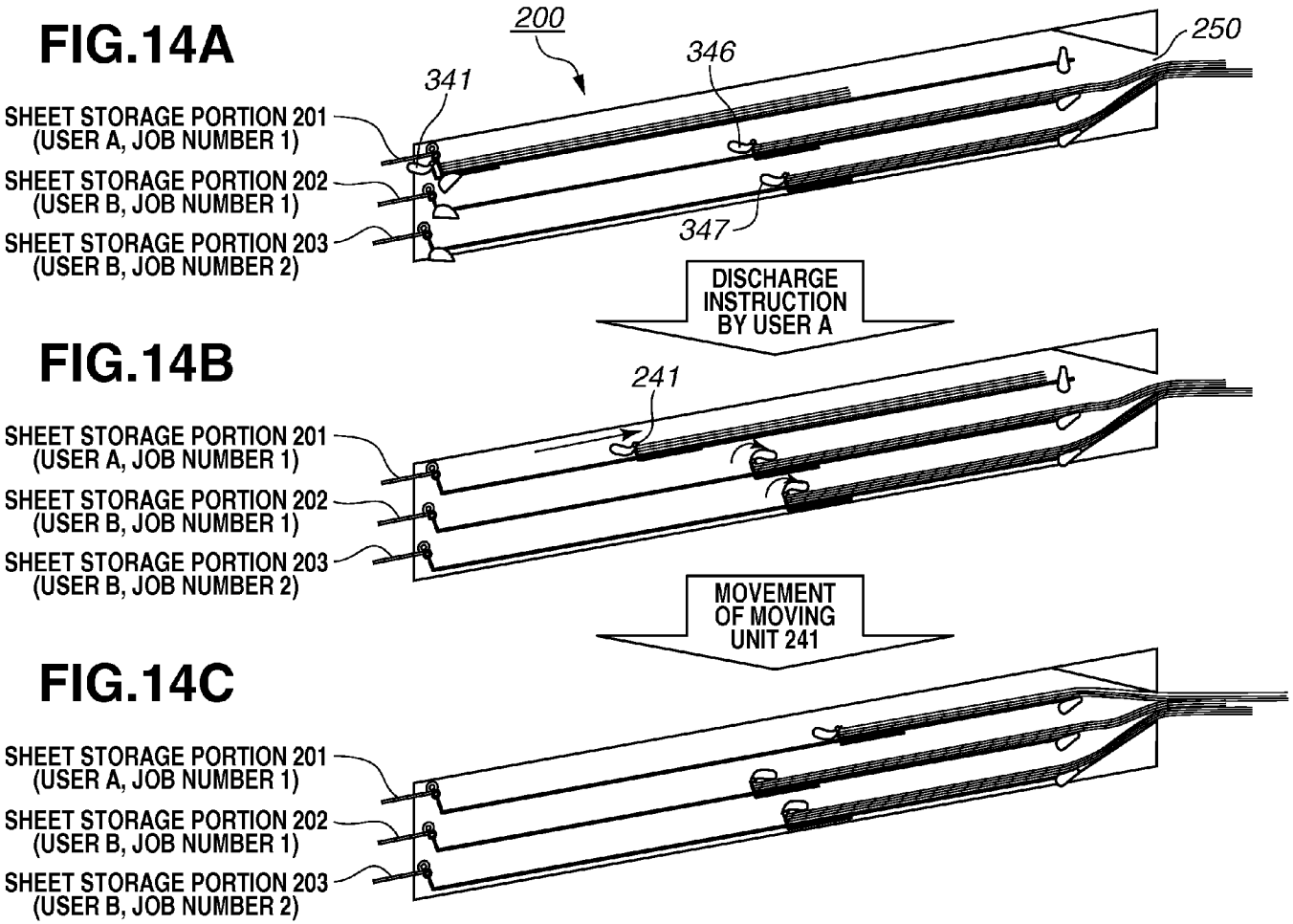
FIGS. 14A, 14B, and 14C illustrate operational states of the sheet storage device according to the second exemplary embodiment.

FIGS. 14A, 14B, and 14C illustrate control examples according to the present exemplary embodiment. In FIG. 14A, each sheet S stored in the sheet storage portion 201 belongs to the user A. Each sheet S stored in respective sheet storage portions 202 and 203 belongs to the user B. Further, each sheet S of the user B stored in the sheet storage portions 202 and 203 is partly exposed through the opening 250. In the above-mentioned state, if the user A instructs to discharge the sheets S, the controller 302 causes the pressing members 346 and 347 to move from the retreat position to the pressing position in the sheet storage portions 202 and 203, as illustrated in FIG. 14B. Further, the controller 302 causes the moving unit 241 to move the sheets S of the user A stored in the sheet storage portion 201 toward the opening 250. As a result, as illustrated in FIG. 14C, both the sheets S of the user A and the sheets S of the user B expose partly beyond the opening 250. At this moment, if the length of the sheets S of the user A exposed from the opening 250 is longer than the protruding length of the sheets S of the user B, the user A can easily recognize its own sheets S when the user A picks up the sheets S. Further, even when the user A erroneously grabs other sheets S (i.e., the sheets S belonging to the user B), the user A cannot take out the sheet S of other user because the pressing members 346 and 347 hold the other user's sheets S firmly. In this case, it may be useful to prevent the pressing members 346 and 347 from moving to the pressing position before the sheets S of the user A are moved. However, in that case, it is necessary to cause the pressing members 346 and 347 to move to the pressing position before the front edge of the sheets S of the user A contacts the sheets S of the user B.

As mentioned above, the pressing member holds the sheets S belonging to the user B if the user A instructs the image forming apparatus to expose the sheets S of the user A in a state where the sheets S of the user B are in the exposed state. Therefore, it is feasible to prevent the sheets S of the user B from being taken out by the user A when the sheets S of the user B are left without being picked up by the user B.

Further, in the present exemplary embodiment, when a sheet S is newly stacked on the exposed sheet S in a state where the exposed sheet S is held, the exposed sheet S can be positioned accurately due to a friction acting between the sheets S. If the position of the exposed sheet S deviates, it is not easy for a user to pick up all the sheets S together or the sheets S may fall from the opening 250. The present exemplary embodiment can solve such a problem.

Further, in the present exemplary embodiment, when a sheet S is newly exposed, the sheets S already exposed beyond the opening 250 are entirely held. However, when the friction and other influences are taken into consideration, it will be sufficient to hold only the sheet S that contacts the newly exposed sheet S at the opening 250. To this end, in the example illustrated in FIGS. 14A to 14C, it is useful to hold only the sheets S stored in the sheet storage portion 202.

According to the configuration described according to the first exemplary embodiment and the configuration described according to the second exemplary embodiment, the sheet S exposed beyond the opening 250 is held at a rear end thereof to prevent the remaining sheet from being taken out by other user. However, the configuration of the sheet storage device 200 is not limited to the illustrated examples. For example, it is useful to configure the pressing member of the sheet storage device 200 to move the sheet S from the above-mentioned exposed position (i.e., the state where the sheet S partly exposes beyond the opening 250) to an inner portion.

Figure 15A:
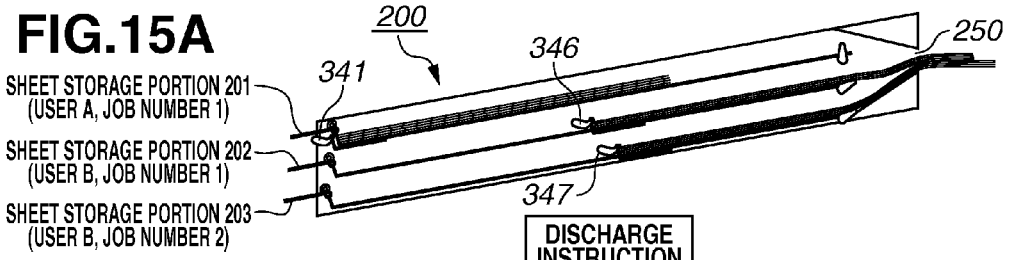
FIGS. 15A to 15E illustrate operational states of the sheet storage device according to a modified embodiment.
Figure 15B:
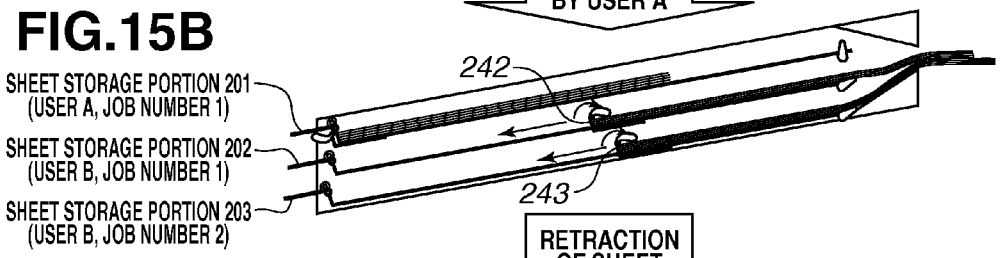
Figure 15C:
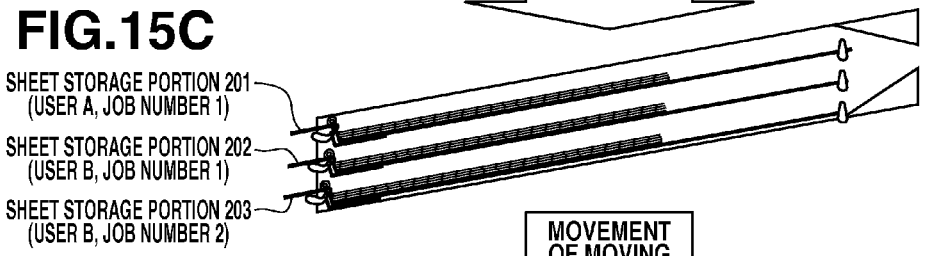
Figure 15D:
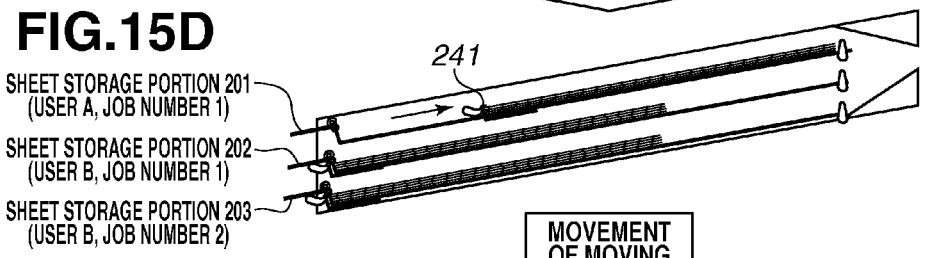
Figure 15E:
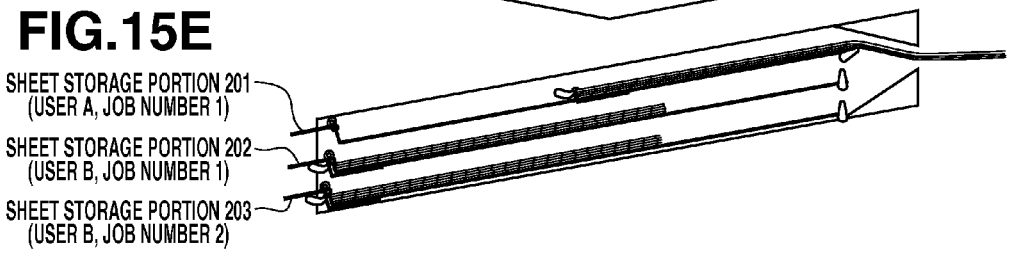

FIGS. 15A to 15E illustrate operational states of the sheet storage device 200 according to a modified embodiment. In FIG. 15A, each sheet S stored in the sheet storage portion 201 belongs to the user A. Each sheet S stored in respective sheet storage portions 202 and 203 belongs to the user B. Further, the sheets S of the user B stored in the sheet storage portions 202 and 203 are exposed partly through the opening 250. If the user A instructs a discharge operation of the sheets S, the controller 302 causes the pressing members 346 and 347 to move from the retreat position to the pressing position in the sheet storage portions 202 and 203 as illustrated in FIG. 15B. Then, the controller 302 causes the moving units 242 and 243 to move the sheets S toward the stack position from the exposure position. As a result, as illustrated in FIG. 15C, the sheets S of the user B are completely retracted into the apparatus body from the state where the sheets S are partly exposed beyond the opening 250. Then, as illustrated in FIG. 15D, the controller 302 causes the moving unit 241 to move the sheets S of the user A toward the opening 250 in the sheet storage portion 201. As a result, as illustrated in FIG. 15E, only the sheets S of the user A are partly exposed beyond the opening 250. As described above, compared to the first exemplary embodiment and the second exemplary embodiment, the sheet storage device 200 according to the modified embodiment can retract a sheet S into the apparatus body from the exposure position where the sheet S is partly exposed. Therefore, the modified embodiment is useful in that the sheet can be surely prevented from being taken out by other user. Further, the modified embodiment is useful in that the confidentiality of information printed on the exposed sheet S can be enhanced.

Further, in the above-mentioned configuration, it is useful to newly stack a sheet S of the user A and expose the newly stacked sheet S partly in a state where the exposed sheets S of the user B are pressed and held by the pressing member, as described in the second exemplary embodiment. Further, it is useful that the sheets S of the user B are subsequently retracted into the apparatus body.

In the above-mentioned exemplary embodiment, the position detection unit is not limited to the configuration including the sensor flag 344. For example, the position detection unit can be configured to detect a change in the torque of the actuator that rotates the pressing member and hold the pressure at an optimum level based on a generated load detected when the sheet S is pressed. Further, it is unnecessary to provide an independent actuator if the driving force can be transmitted via a clutch from another actuator.

Figure 16A:
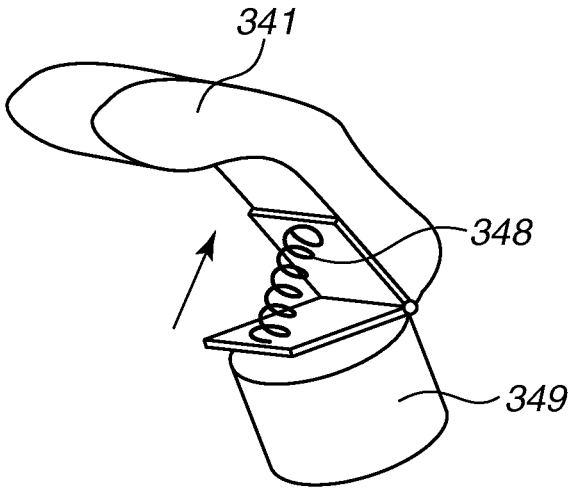
FIGS. 16A and 16B illustrate a configuration of another pressing member.
Figure 16B:
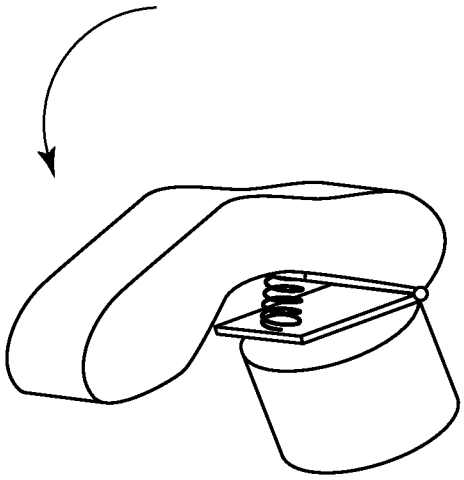

Further, in the above-mentioned exemplary embodiment, the pressing member 341 can be rotated using a spring 348 and a solenoid 349 as illustrated in FIG. 16. When the pressing member 341 does not hold any sheet, the pressing member 341 is kept at a lift-up position by the spring 348 as illustrated in FIG. 16A. In other words, the pressing member 341 is held in a stationary state at the retreat position where the pressing member 341 does not contact the sheet S. When the pressing member 341 holds the sheet S, the pressing member 341 inclines toward the solenoid 349 under the magnetic attraction force of the solenoid 349 as illustrated in FIG. 16B. Thus, the pressing member 341 can hold the sheet S when the pressing member 341 contacts (reaches) the sheet S. If the solenoid 349 is turned off, the pressing member 341 returns to the state illustrated in FIG. 16A under the resilient force of the spring 348. According to the above-mentioned configuration using the solenoid 349 and the spring 348, it is unfeasible to arbitrarily change the holding force applied to the sheets S according to the number of sheets S stored in the sheet storage portion 201. However, the above-mentioned configuration is simple in configuration and control. Therefore, the above-mentioned configuration is useful when it is unnecessary to change the holding force, for example, when the maximum number of sheets S that can be stored in the sheet storage portion 201 is small. Alternatively, it is also useful to use the spring 348 to push the pressing member 341 to hold the sheet S and use the solenoid 349 to return the pressing member 341 to the original position, although not illustrated in the drawings.

Further, in the above-mentioned exemplary embodiment, an individual actuator is provided for a moving unit dedicated to each sheet storage portion. Therefore, by driving all actuators, the sheets stored in a plurality of sheet storage portions can be exposed simultaneously in a stacked state. On the other hand, the number of the actuators can be set to be smaller compared to the number of the sheet storage portions. In this case, a driving force switching unit, such as a clutch (not illustrated), can be provided to enable a single actuator to selectively move each one of the plurality of moving units.

Further, in the above-mentioned exemplary embodiments, the memory 305 is provided in the controller 302. However, the memory 305 can be provided in the engine control unit 303 or in the sheet storage device control unit 304. Alternatively, the memory 305 can be independently provided in the image forming apparatus control unit 301.

Further, in the above-mentioned exemplary embodiments, the engine control unit 303 and the sheet storage device control unit 304 are separately provided. However, the engine control unit 303 and the sheet storage device control unit 304 can be integrated as a single unit. In this case, the engine control unit 303 can be configured to control the conveyance unit 105 and the sheet storage device 200.

Further, according to the configuration described in the present exemplary embodiment, a plurality of sheet conveyance paths merge on the downstream side of each sheet storage portion and only one opening is provided. However, it is also useful to provide a plurality of openings separately so that the sheets stored in respective sheet storage portions can be exposed through individual openings. Further, when the sheets are exposed together in a stacked state through one of the plurality of openings from the plurality of sheet storage portions, it is feasible to prevent the position of the exposed sheet from deviating. In other words, the effect of the second exemplary embodiment can be obtained.

Further, according to the configurations described in the above-mentioned exemplary embodiments, the image forming apparatus includes three sheet storage portions. However, the number of the sheet storage portions is not limited to three. In determining the number of the sheet storage portions, it is adequate to take the environment in which the apparatus body is used, the number of users who commonly use the apparatus or the spec of the apparatus body into consideration.

Further, according to the configurations described in the above-mentioned exemplary embodiments, the sheet storage device 200 is integrated with the image forming apparatus 100. Alternatively, the sheet storage device 200 can be configured to be detachable from the image forming apparatus 100. In this case, the control unit provided in the image forming apparatus 100 can control the operations of the sheet storage device 200. Further, it is also useful that the sheet storage device 200 includes an independent control unit that can communicate with the control unit provided in the image forming apparatus 100 to perform various operations.

Further, the image forming apparatus is not limited to the laser beam printer illustrated in the above-described exemplary embodiments. For example, the image forming apparatus can be an inkjet printer, another printing type printer, or a copy machine.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-197216 filed Sep. 24, 2013, which is hereby incorporated by reference herein in its entirety.

What is claimed is:

1. An image forming apparatus comprising:

a main body formed with an opening;

a storage portion configured to store a sheet, on which an image is formed, inside the main body;

a moving unit configured to move the sheet stored in the storage portion in a predetermined direction and stop the sheet in a exposure state that a part of the sheet is exposed outside the main body through the opening; and a pressing unit configured to be moved between a pressing position where the pressing unit presses a surface of the sheet in the exposure state and a retreat position where the pressing unit retracts from the pressing position, wherein, after the pressing unit moves from the retreat position to the pressing position to press the surface of the sheet in the exposure state, the moving unit moves in a direction opposite to the predetermined direction to cause the part of the sheet not to expose from the opening.

2. The image forming apparatus according to claim 1, further comprising a detection unit configured to detect the sheet in the exposure state, wherein in a case where the detection unit detects the sheet in the exposure state and a predetermined time elapses while the sheet is exposed from the opening, the pressing unit moves from the retreat position to the pressing position to press the surface of the sheet in the exposure state and then the moving unit moves in the direction opposite to the predetermined direction to cause the part of the sheet not to expose from the opening.

3. The image forming apparatus according to claim 1, further comprising:

a detection unit configured to detect the sheet in the exposure state; and a human body detection unit configured to detect the presence of a human body near the image forming apparatus;

wherein in a case where the detection unit detects the sheet in the exposure state and a detection state of the human body detection unit is switched from a human body presence state to a human body absence state, the pressing unit moves from the retreat position to the pressing position to press the surface of the sheet in the exposure state and then the moving unit moves in the direction opposite to the predetermined direction to cause the part of the sheet not to expose from the opening.

4. The image forming apparatus according to claim 1, wherein if an instruction to discharge the sheet is received after the pressing unit has reached the pressing position, the pressing unit moves to the retreat position.

5. The image forming apparatus according to claim 1, further comprising a conveyance unit configured to convey a sheet on which an image is formed to the storage portion;

wherein the conveyance unit conveys the sheet to the storage portion in a state where the pressing unit stays in the retreat position.

6. The image forming apparatus according to claim 1, wherein the pressing unit is attached to the moving unit so as to move with the moving unit and the pressing unit includes a pressing member that presses a rear end of the sheet stored in the sheet storage portion.

7. The image forming apparatus according to claim 1, wherein, when the pressing unit moves to the retreat position, the pressing unit is apart from the surface of the sheet.

8. An image forming apparatus comprising:

a main body formed with an opening;

a plurality of storage portions each configured to store a sheet, on which an image is formed, inside the image forming apparatus;

a moving unit configured to move a sheet stored in a storage portion, which is one of the plurality of storage portions, and stop the sheet in a exposure state that a part of the sheet is exposed from the opening;

a pressing unit configured to be moved between a pressing position where the pressing unit presses a surface of the sheet in the exposure state and a retreat position where the pressing unit retracts from the pressing position; and a detection unit configured to detect the sheet in the exposure state, wherein in a state where the detection unit detects a first sheet having been moved by the moving unit from a first storage portion from among the plurality of storage portions and in the exposure state, the pressing unit moves from the retreat position to the pressing position to press the surface of the first sheet in a case where the moving unit moves a second sheet stored in a second storage portion, different from the first storage portion, toward the opening.

9. The image forming apparatus according to claim 8, wherein at least before a front edge of the second sheet contacts the first sheet when the moving unit moves the second sheet toward the opening, the pressing unit moves from the retreat position to the pressing position to press the surface of the first sheet.

10. The image forming apparatus according to claim 8, wherein the moving unit moves the second sheet toward the opening so that a length of the second sheet exposed from the opening is longer than a length of the first sheet exposed from the opening.

11. The image forming apparatus according to claim 8, wherein after the moving unit causes a part of the second sheet to be exposed from the opening, the pressing unit moves to the retreat position and does not press the surface of the first sheet if a predetermined time has not yet elapsed after the moving unit has caused a part of the first sheet to be exposed from the opening.

12. The image forming apparatus according to claim 8, further comprising a conveyance unit configured to convey a sheet on which an image is formed to the storage portion;

wherein the conveyance unit conveys the sheet to the storage portion in a state where the pressing unit stays in the retreat position.

13. The image forming apparatus according to claim 8, wherein the pressing unit is attached to the moving unit so as to move with the moving unit and the pressing unit includes a pressing member that presses a rear end of the sheet stored in the sheet storage portion.

14. The image forming apparatus according to claim 8, wherein, when the pressing unit moves to the retreat position, the pressing unit is apart from the surface of the sheet.

15. An image forming apparatus comprising:

a main body formed with an opening;

a storage portion configured to store a sheet, on which an image is formed, inside the main body;

a moving unit configured to move the sheet stored in the storage portion and stop the sheet in a exposure state that a part of the sheet is exposed outside the main body through the opening;

a pressing unit configured to be moved between a pressing position where the pressing unit presses a surface of the sheet in the exposure state and a retreat position where the pressing unit retracts from the pressing position; and a detection unit configured to detect the sheet in the exposure state, wherein a timing at which the pressing unit moves from the retreat position to the pressing position to press the surface of the sheet in the exposure state is determined based on a detection result of the detection unit, and wherein, after the pressing unit moves from the retreat position to the pressing position to press the surface of the sheet in the exposure state, the sheet pressed by the pressing unit remains in the exposure state.

16. The image forming apparatus according to claim 15, wherein in a case where the detection unit detects the sheet in the exposure state and a predetermined time elapses while the sheet is exposed from the opening, the pressing unit moves from the retreat position to the pressing position to press the surface of the sheet in the exposure state and then the sheet pressed by the pressing unit remains in the exposure state.

17. The image forming apparatus according to claim 15, further comprising:

a human body detection unit configured to detect the presence of a human body near the image forming apparatus, wherein in a case where the detection unit detects the sheet in the exposure state and a detection state of the human body detection unit is switched from a human body presence state to a human body absence state, the pressing unit moves from the retreat position to the pressing position to press the surface of the sheet in the exposure state and then the sheet pressed by the pressing unit remains in the exposure state.

18. The image forming apparatus according to claim 15, wherein if an instruction to discharge the sheet is received after the pressing unit has reached the pressing position, the pressing unit moves to the retreat position.

19. The image forming apparatus according to claim 15, further comprising a conveyance unit configured to convey a sheet on which an image is formed to the storage portion;

wherein the conveyance unit conveys the sheet to the storage portion in a state where the pressing unit stays in the retreat position.

20. The image forming apparatus according to claim 15, wherein the pressing unit is attached to the moving unit so as to move with the moving unit and the pressing unit includes a pressing member that presses a rear end of the sheet stored in the storage portion.

21. The image forming apparatus according to claim 15, wherein, when the pressing unit moves to the retreat position, the pressing unit is apart from the surface of the sheet.

* * * * *